US009962961B2

(12) United States Patent
Chiba et al.

(10) Patent No.: US 9,962,961 B2
(45) Date of Patent: May 8, 2018

(54) PRINTING APPARATUS

(71) Applicant: SEIKO EPSON CORPORATION, Tokyo (JP)

(72) Inventors: Satoshi Chiba, Suwa (JP); Yoshikazu Koike, Chino (JP); Kazunori Mori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/049,484

(22) Filed: Feb. 22, 2016

(65) Prior Publication Data

US 2016/0243854 A1 Aug. 25, 2016

(30) Foreign Application Priority Data

Feb. 25, 2015 (JP) ..... 2015-035394
Jan. 13, 2016 (JP) ..... 2016-004161

(51) Int. Cl.
*B41J 29/17* (2006.01)
*B41J 11/00* (2006.01)

(52) U.S. Cl.
CPC ..... *B41J 11/007* (2013.01); *B41J 11/0015* (2013.01)

(58) Field of Classification Search
USPC ..... 347/104, 129, 154; 271/275
See application file for complete search history.

(56) References Cited

U.S. PATENT DOCUMENTS 4,526,357 A * 7/1985 Kuehnle ..... B65H 3/18 271/128
5,003,325 A * 3/1991 Bibl ..... G01D 15/28 271/18.1
5,219,154 A * 6/1993 Fukube ..... B65H 3/18 271/18.2
5,420,743 A * 5/1995 Domes ..... B65H 37/00 361/214
5,794,110 A * 8/1998 Kasai ..... G03G 15/0131 399/299
5,930,556 A * 7/1999 Imamiya ..... G03G 15/0131 399/299
6,092,800 A * 7/2000 Compera ..... B65H 5/004 198/691
6,267,225 B1 * 7/2001 Compera ..... B41F 21/00 198/691
6,511,172 B2 * 1/2003 Tanno ..... B41J 11/0005 198/691

(Continued)

FOREIGN PATENT DOCUMENTS

JP 2004-149280 A 5/2004
JP 2008110843 A * 5/2008
JP 2009-007119 A 1/2009

*Primary Examiner* — Matthew Luu
*Assistant Examiner* — Lily Kemathe
(74) *Attorney, Agent, or Firm* — Workman Nydegger

(57) ABSTRACT

A printing apparatus includes a transport belt that transports a sheet, a charging roller that supplies an electric charge to the transport belt, a print head that causes ink to be attached to a printing surface of the sheet electrostatically adsorbed on the transport belt, a charge eliminating unit that is displaceable between a charge elimination position and a retreated position and that eliminates the electric charge from the printing surface by coming in contact with the printing surface of the sheet, and a charge elimination control device that controls the position of the charge eliminating unit.

12 Claims, 9 Drawing Sheets

(56) References Cited

U.S. PATENT DOCUMENTS

| | | | | |
|---|---|---|---|---|
| 6,716,286 | B2 * | 4/2004 | Louks | B05C 5/008 118/627 |
| 7,036,921 | B2 * | 5/2006 | Kanome | B41J 11/007 271/193 |
| 7,576,509 | B2 * | 8/2009 | Komatsu | H02P 6/15 318/567 |
| 8,752,955 | B2 * | 6/2014 | Kobayashi | B41J 11/007 271/193 |
| 8,870,183 | B2 * | 10/2014 | Takano | B65H 85/00 271/184 |
| 9,132,671 | B2 * | 9/2015 | Hannig | B41J 11/02 |
| 2006/0261298 | A1 * | 11/2006 | Matsumoto | B65H 5/004 250/590 |
| 2007/0120936 | A1 * | 5/2007 | Kawabata | B41J 11/007 347/104 |
| 2009/0136279 | A1 * | 5/2009 | Kawabata | G03G 15/234 399/401 |
| 2011/0261130 | A1 * | 10/2011 | Hirai | B41J 11/007 347/104 |
| 2013/0113869 | A1 * | 5/2013 | Kobayashi | B41J 11/007 347/104 |
| 2016/0246244 | A1 * | 8/2016 | Mori | B41J 11/0085 |

* cited by examiner

PRINTING APPARATUS

BACKGROUND

1. Technical Field

The present invention relates to a printing apparatus that carries out printing on a printing medium electrostatically adsorbed on a transport belt.

2. Related Art

JP-A-2004-149280 discloses an example of a printing apparatus provided with a transport belt and a print head that discharges a printing material such as ink toward a printing medium. In such a printing apparatus, when a transport belt is charged by a charging unit, the printing medium fed onto the transport belt is electrostatically adsorbed on the transport belt. When the printing medium is transported by the operation of the transport belt, printing material from the print head is attached to the printing surface that is the surface that does not come in contact with transport belt of both surfaces of the printing medium.

Incidentally, in order to increase the efficiency of the electrostatic adsorption of the printing medium by the transport belt, it is desirable to eliminate the electric charge from the printing surface of the printing medium. Here, a charge eliminating unit that eliminates the electric charge from the printing surface by coming in contact with the printing surface of the printing medium may be provided in such a printing apparatus.

However, in this case the charge eliminating unit gradually deteriorates because the charge eliminating unit is made to come in contact with the printing medium in order to eliminate the electric charge from the printing surface of the printing medium. When the deterioration of the charge eliminating unit proceeds in this way, the elimination efficiency of the electric charge from the printing medium by the charge eliminating unit is lowered.

SUMMARY

An advantage of some aspects of the invention is to provide a printing apparatus that is able to suppress lowering of the elimination efficiency of the electric charge from the printing medium by the charge eliminating unit.

According to an aspect of the invention, there is provided a printing apparatus, including a transport belt that transports a printing medium; a charging unit that supplies an electric charge to the transport belt; a print head that causes a printing material to be attached to a printing surface of the printing medium that is electrostatically adsorbed on the transport belt, in a case where a surface that comes in contact with the transport belt of both surfaces of the printing medium is a contact surface and a surface on an opposite side to the contact surface is the printing surface; a charge eliminating unit that is displaceable between a charge elimination position able to come in contact with the printing medium transported by the transport belt and a retreated position unable to come in contact with the printing medium, and that removes the electric charge from the printing surface by coming in contact with the printing surface of the printing medium; and a charge elimination control device that controls the position of the charge eliminating unit, in which the charge elimination control device arranges the charge eliminating unit at the charge elimination position when the printing medium electrostatically adsorbed on and transported by the transport belt is at the position able to come in contact with the charge eliminating unit.

According to the configuration, making the charge eliminating unit come in contact with printing medium transported by the transport belt and not allowing the charge eliminating unit to come in contact with printing medium can be selected when printing on the printing medium. Therefore, compared to a case where the charge eliminating unit is constantly arranged at the charge elimination position, deterioration of the charge eliminating unit is delayed by the amount it is possible to reduce the chance of the charge eliminating unit coming in contact with the printing medium or transport belt. By the deterioration of the charge eliminating unit being delayed in this way, lowering of the elimination efficiency of the electric charge from the printing medium by the charge eliminating unit can be lowered.

In the printing apparatus, it is preferable that the charge elimination control device determines whether the charge eliminating unit is made to come in contact with the printing medium transported by the transport belt and controls the position of the charge eliminating unit based on the determination results according to the type of printing medium that is a printing target.

By specifying the type of printing medium, it can be determined whether the printing medium is one in which curling easily occurs due to attachment of the printing material or is one with a high resistance value. When the printing medium is one in which curling easily occurs or when the printing medium is one with a high resistance value, it is desirable that the electrostatic adsorption force of the printing medium be increased by the transport belt by eliminating the electric charge from the printing surface of the printing medium with the charge eliminating unit. On the other hand, the electrostatic adsorption force of the printing medium due to the transport belt may not be increased to this extent when curling does not easily occur in the printing medium or when the resistance value of the printing medium is low. Here, in the configuration, whether the charge eliminating unit is arranged at the charge elimination position or arranged at the retreated position is determined according to the type of printing medium that is the printing target, and the position of the charge eliminating unit is controlled based on the determination results. In so doing, contact between the printing medium and the charge eliminating unit can be avoided when it is possible to determine that the electrostatic adsorption force of the printing medium may not increase due to the transport belt. Therefore, because it is possible for the charge eliminating unit to be arranged at the retreated position during printing according to the type of printing medium that is the printing target, the charge eliminating unit does not easily deteriorate compared to a case where the charge eliminating unit is constantly arranged at the charge elimination position. As a result, lowering of the elimination efficiency of the electric charge from the printing medium by the charge eliminating unit can be suppressed.

In the printing apparatus, it is preferable that the charge elimination control device determines whether the charge eliminating unit is made to come in contact with the printing medium transported by the transport belt and controls the position of the charge eliminating unit based on the determination results based on a humidity of an installation environment of the printing apparatus.

The higher the humidity of the installation environment of the printing apparatus becomes, the more easily the resistance value of the printing medium is reduced. Even if the electric charge is not eliminated from the printing surface of the printing medium by the charge eliminating unit when the resistance value of the printing medium is low, the electric charge of the printing surface naturally becomes easily neutralized. That is, even if the electric charge is not eliminated from the printing surface of the printing medium by the charge eliminating unit, the electrostatic adsorption force of the printing medium due to the transport belt increases. Here, in this configuration, the position of the charge eliminating unit is controlled in consideration of the humidity of the installation environment of the printing apparatus. Therefore, the charge eliminating unit can be arranged at the retreated position during printing according to the humidity of the installation environment of the printing apparatus. As a result, the charge eliminating unit does not easily deteriorate compared to a case where the charge eliminating unit is constantly arranged at the charge elimination position, lowering of the elimination efficiency of the electric charge from the printing medium by the charge eliminating unit can be suppressed.

It is preferable that the printing apparatus of the aspect further includes a determination device that determines whether a resistance value of the printing medium that is the printing target increases based on a temperature and the humidity of the installation environment of the printing apparatus, in which the charge elimination control device arranges the charge eliminating unit at the charge elimination position when it is determined that the resistance value of the printing medium increases by the determination device or arranges the charge eliminating unit at the retreated position when it is determined that the resistance value of the printing medium decreases by the determination device.

The resistance value of the printing medium changes according to the temperature and humidity of the installation environment of the printing apparatus. The relationship between the temperature and humidity of the installation environment and the resistance value of the printing medium can be ascertained to a given extent by practical testing, simulation, or the like. That is, the resistance value of the printing medium can be estimated based on the temperature and humidity of the installation environment. Here, in the configuration, it is determined whether the resistance value of the printing medium is increased based on the temperature and humidity of the installation environment of the printing apparatus, and the charge eliminating unit is caused to come in contact with printing medium transported by the transport belt when it is possible to determine that the resistance value is increased. Conversely, the charge eliminating unit is not brought into contact with printing medium transported by the transport belt when it is possible to determine that the resistance value of the printing medium is decreased. That is, because the electrostatic adsorption force of the printing medium due to the transport belt is comparatively large when it is possible to predict that the electric charge of the printing surface is easily naturally neutralized even if the electric charge is not eliminated from the printing surface of the printing medium by the charge eliminating unit, the charge eliminating unit is not brought into contact with printing medium. Therefore, lowering of the elimination efficiency of the electric charge from the printing medium by the charge eliminating unit can be suppressed by the amount that the charge eliminating unit becomes less prone to deterioration compared to a case where the charge eliminating unit is constantly arranged at the charge elimination position regardless of the temperature and humidity of the installation environment of the printing apparatus.

It is preferable that the printing apparatus of the aspect further includes a reversal mechanism that reverses a front and back of the printing medium and guides the printing medium on the transport belt so that a first surface becomes the contact surface and a second surface that is a surface on an opposite side of the first surface becomes the printing surface after printing on the first surface of both surfaces of the printing medium is finished, in which the print head is arranged further downstream in the transport direction than the charge elimination position, and the charge elimination control device arranges the charge eliminating unit at the charge elimination position when carrying out printing on the second surface of the printing medium guided on the transport belt from the reversal mechanism.

When performing duplex printing on the printing medium, curling easily occurs in the printing medium on the transport belt when performing printing on the second side in a situation with the printing material attached by printing on the first side. Here, in the configuration, the charge eliminating unit is arranged at the charge elimination position when performing printing on the second surface of the printing medium guided from the reversal mechanism on the transport belt, and the electric charge is eliminated from the second surface of the printing medium by the charge eliminating unit. By eliminating the electric charge from the second surface in this way, the electrostatic adsorption force of the printing medium due to the transport belt can be increased, and it becomes difficult for the medium to curl on the transport belt. As a result, the occurrence of printing defects can be suppressed by the amount that it becomes difficult for a phenomenon in which the printing medium comes in contact with the print head or the like to occur.

It is preferable that the printing apparatus further includes a reversal mechanism that reverses a front and back of the printing medium and guides the printing medium on the transport belt so that a first surface becomes the contact surface and a second surface that is a surface on an opposite side to the first surface becomes the printing surface after printing on the first surface of both surfaces of the printing medium is finished, in which the charge elimination control device determines whether the printing medium is curled due to printing on the first surface of the printing medium, and arranges the charge eliminating unit at the charge elimination position when printing on the second surface of the printing medium when it is determined that the printing medium is curled due to printing on the first surface of the printing medium, and arranges the charge eliminating unit at the retreated position when printing on the second surface of the printing medium when it is determined that the printing medium is not curled due to printing on the first surface of the printing medium.

According to the configuration, the charge eliminating unit is not brought into contact with printing medium when printing on the second surface in a case where it is determined that the printing medium does not curl even if printing is performed on the first surface. Therefore, regardless of form of printing on the first surface, lowering of the elimination efficiency of the electric charge from the printing medium by the charge eliminating unit can be suppressed by the amount that the charge eliminating unit becomes less prone to deterioration compared to a case where the charge eliminating unit is constantly arranged at the charge elimination position during printing on the second surface.

It is preferable that the printing apparatus further includes a reversal mechanism that reverses a front and back of the printing medium and guides the printing medium on the transport belt so that a first surface becomes the contact surface and a second surface that is a surface on an opposite side to the first surface becomes the printing surface after printing on the first surface of both surfaces of the printing medium is finished, in which the printing medium includes four lateral edges and includes corners that are connection parts for two of the lateral edges, and in a case where the first surface of the printing medium is divided into a plurality of regions, and a region that includes a corner of the printing medium of each region is the determination region, the charge elimination control device calculates the maximum discharge amount that is the maximum amount of the printing material that is able to be attached to the determination region through discharge of the printing material from the print head to the determination region, calculates the discharge amount that is the amount of printing material discharged from the print head to the determination region based on printing data employed in printing on the first surface of the printing medium, calculates the discharge ratio that is the ratio of the discharge amount to the maximum discharge amount, arranges the charge eliminating unit at the retreated position when printing on the second surface of the printing medium when the discharge ratio in the determination region is less than the determination ratio, and arranges the charge eliminating unit at the charge elimination position when printing on the second surface of the printing medium when the discharge ratio in the determination region is the determination ratio or higher.

As the amount of the printing material attached to the region including the corner of the printing medium by the printing on the first surface increases, the printing medium more easily curls. Here, in the configuration, because it can be determined that there is potential for the printing medium to curl due to printing on the first surface when the region including the corner of the printing medium from the plurality of regions into which the first surface is divided is the determination region and the discharge ratio of the determination region is the determination ratio or higher, printing on the second surface is performed with the charge eliminating unit caused to come in contact with printing medium thereby increasing the electrostatic adsorption force of the printing medium due to the transport belt. Therefore, the occurrence of printing defects can be suppressed by the amount that it becomes difficult for a phenomenon in which the printing medium comes in contact with the print head or the like to occur when printing on the second surface. Meanwhile, because it is can be determined that the printing medium does not curl due to printing on the first surface when the discharge ratio on the determination region is less than the determination ratio, the charge eliminating unit is not brought into contact with printing medium, and printing is performed on the second surface. In this way, deterioration of the charge eliminating unit can be suppressed and lowering of the elimination efficiency of the electric charge from the printing medium by the charge eliminating unit can be suppressed by the amount that is possible to reduce the chance of the charge eliminating unit coming in contact with the printing medium.

It is preferable that the printing apparatus further includes a reversal mechanism that reverses a front and back of the printing medium and guides the printing medium on the transport belt so that a first surface becomes the contact surface and a second surface that is a surface on an opposite side to the first surface becomes the printing surface after printing on the first surface of both surfaces of the printing medium is finished, in which the printing medium includes four lateral edges and includes corners that are connection parts for two of the lateral edges, and in a case where the first surface of the printing medium is divided into a plurality of regions, and a region that is configured by an end region that is a region including a corner of the printing medium and a region that neighbors the end region of each of the regions is the determination region, the charge elimination control device calculates the maximum discharge amount that is the maximum amount of the printing material that is able to be attached to the determination region through discharge of the printing material from the print head to the determination region, calculates the discharge amount that is the amount of printing material discharged from the print head to the determination region based on printing data employed in printing on the first surface of the printing medium, calculates the discharge ratio that is the ratio of the discharge amount to the maximum discharge amount, arranges the charge eliminating unit at the retreated position when printing on the second surface of the printing medium when the discharge ratio in the determination region is less than the determination ratio, and arranges the charge eliminating unit at the charge elimination position when printing on the second surface of the printing medium when the discharge ratio in the determination region is the determination ratio or higher.

As the amount of the printing material attached to the region including the corner of the printing medium by the printing on the first surface increases, the printing medium more easily curls. Here, in the configuration, the region configured by the end region that includes the corner of the printing medium and the region that neighbors the end region from the plurality of regions into which the first surface is divided is made the determination region. Because it is possible to determine that there is potential for the printing medium to curl due to printing on the first surface when the discharge ratio of the determination region is the determination ratio or higher, printing on the second surface is performed with the charge eliminating unit caused to come in contact with printing medium thereby increasing the electrostatic adsorption force of the printing medium due to the transport belt. Therefore, the occurrence of printing defects can be suppressed by the amount that it becomes difficult for a phenomenon in which the printing medium comes in contact with the print head or the like to occur when printing on the second surface. Meanwhile, because it is can be determined that the printing medium does not curl due to printing on the first surface when the discharge ratio on the determination region is less than the determination ratio, the charge eliminating unit is not brought into contact with printing medium, and printing is performed on the second surface. In this way, deterioration of the charge eliminating unit can be suppressed and lowering of the elimination efficiency of the electric charge from the printing medium by the charge eliminating unit can be suppressed by the amount that is possible to reduce the chance of the charge eliminating unit coming in contact with the printing medium.

In the printing apparatus, it is preferable that a plurality of determination regions including one of the corners is set on the first surface of the printing medium, and the charge elimination control device arranges the charge eliminating unit at the retreated position when printing to the second surface of the printing medium when the discharge ratio in all of the determination regions is less than the determination ratio, and arranges the charge eliminating unit at the charge elimination position when printing on the second surface of the printing medium when the discharge ratio in at least one of the determination regions of each of the determination regions is the determination ratio or higher.

According to the configuration, it is determined whether the discharge ratio is the determination ratio or higher for each determination region, and it can be determined if there is potential for the printing medium to curl due to the printing on the first surface even when there is one determination region for which the discharge ratio is the determination ratio or higher. Therefore, upon causing the charge eliminating unit to come in contact with printing medium to increase the electrostatic adsorption force of the printing medium due to the transport belt, printing is performed on the second surface. Meanwhile, because it is possible to determine that the printing medium does not curl due to printing on the first surface when there is no determination region for which the discharge ratio is the determination ratio or higher, the charge eliminating unit is not brought into contact with printing medium, and printing is performed on the second surface. In this way, deterioration of the charge eliminating unit can be suppressed and lowering of the elimination efficiency of the electric charge from the printing medium by the charge eliminating unit can be suppressed by the amount that is possible to reduce the chance of the charge eliminating unit coming in contact with the printing medium.

In the printing apparatus, it is preferable that a variable pressing force mechanism unit that is able to change the pressing force of the charge eliminating unit on the printing medium electrostatically adsorbed on the transport belt with the charge eliminating unit at the charge elimination position is included, in which the charge elimination control device causes the pressing force of the charge eliminating unit to change according to the discharge ratio using the variable pressing force mechanism unit.

The potential for the degree of the curling of the printing medium, that is, the curvature to which the printing medium is curved, is high when the discharge ratio is high. Here, according to the configuration, since the pressing force of the charge eliminating unit can be increased when the discharge ratio is high, the resistance force when the charge eliminating unit comes in contact with the printing medium can be suppressed, a printing medium with a curled shape can be stretched, and the contact area with the transport belt on the printing medium can be increased.

In the printing apparatus, it is preferable that the charge elimination control device arranges the charge eliminating unit at the retreated position when carrying out printing on the first surface of the printing medium.

Because the printing material is not yet attached on the printing medium during printing on the first surface, different to when printing on the second surface, the potential for the printing medium to curl is low. Here, in the configuration, the charge eliminating unit is arranged at the retreated position and the charge eliminating unit is not brought into contact with printing medium even during printing on the first surface. In so doing, lowering of the elimination efficiency of the electric charge from the printing medium by the charge eliminating unit can be suppressed by the amount that the charge eliminating unit becomes less prone to deterioration compared to a case where the charge eliminating unit is arranged at the charge elimination position even during printing on the first surface.

It is preferable that the printing apparatus further includes a support roller which is arranged further upstream in the transport direction than the charge elimination position and that presses the printing medium to the transport belt, in which the support roller is driven to rotate by an operation of the transport belt.

According to the configuration, because the printing medium is pressed to the transport belt by the support rollers, the printing medium can be suitably polarized by the amount that is it possible for the degree of adhesion between the printing medium and the transport belt to be increased. As a result, the printing medium can be more easily electrostatically adsorbed on the transport belt.

In the printing apparatus, it is preferable that the support roller is grounded.

According to the configuration, because the support roller is grounded, the electric charge can be eliminated to a given extent from the printing surface by the support roller coming in contact with printing surface of the printing medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Below, a first embodiment in which the printing apparatus is embodied as an ink jet printer will be described according to FIGS. 1, 2A and 2B, 3A and 3B, and 4 to 6.

Figure 1:
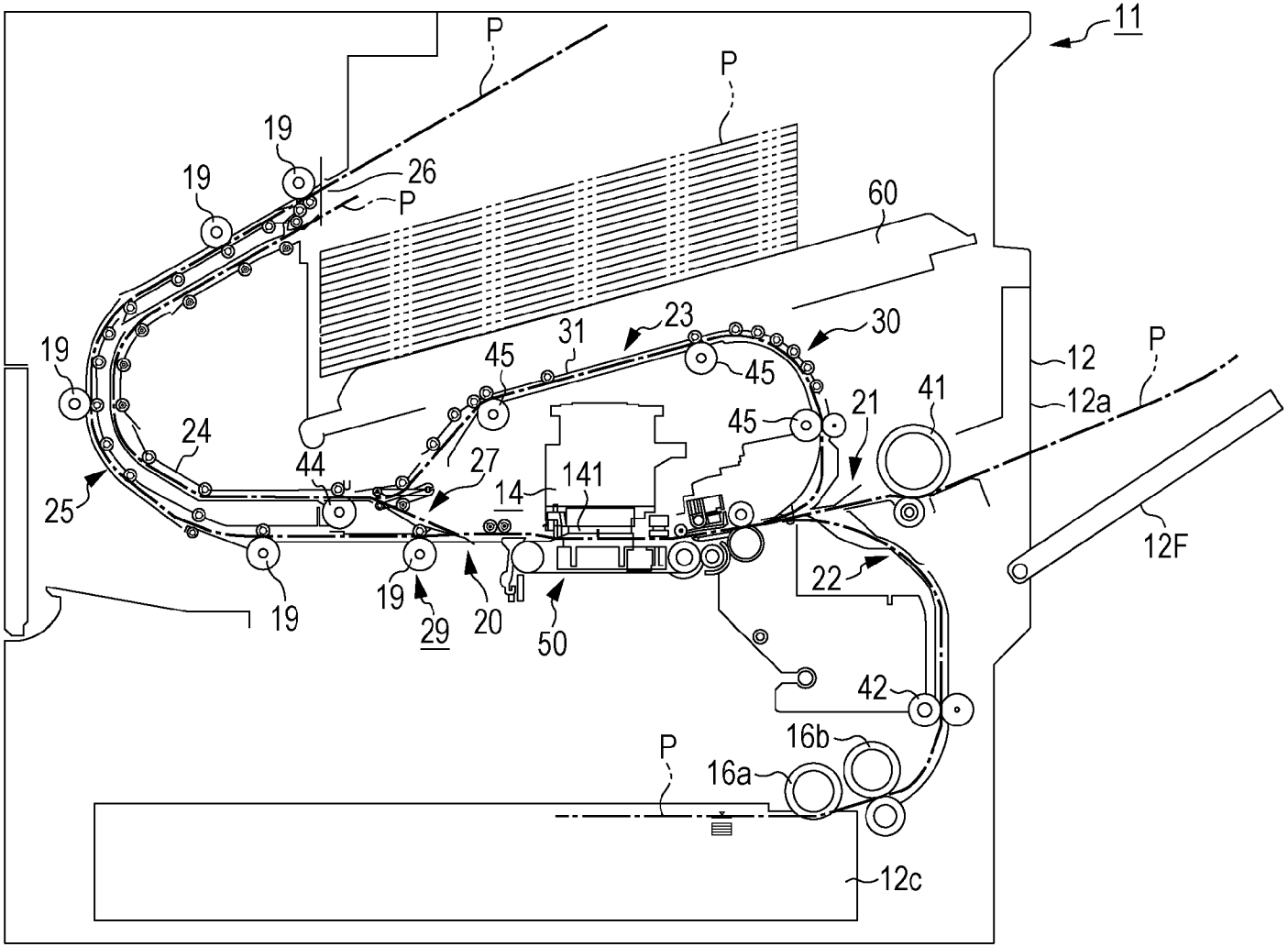
FIG. 1 is a side view illustrating a schematic configuration of a printing apparatus of a first embodiment.

As shown in FIG. 1, a transport device 29 that transports a sheet P that is an example of the printing medium along a medium transport path 20, and a printing unit 14 that carries out printing on the transported sheet P are provided in the housing 12 of the printing apparatus 11 of the embodiment. In a case where the direction orthogonal to the paper surface in FIG. 1 is the width direction of the sheet, the medium transport path 20 is formed so as to transport the sheet P in the direction that intersects the width direction of the sheet and preferably in a direction orthogonal to the width direction.

The printing unit 14 includes a line head-type print head 141 that is able to discharge ink that is an example of the printing material over substantially all regions in the width direction of the sheet at the same time. An image is formed on the sheet P by attaching the ink discharged from the print head 141 to the sheet P.

The transport device 29 includes a discharge mechanism unit 25 that discharges the sheet P on which printing is completed outside the housing 12, and a feeding mechanism unit 30 that feeds the sheet P before printing along the medium transport path 20.

The discharge mechanism unit 25 includes a plurality of discharge roller pairs 19 arranged along the medium transport path 20. The sheet P transported by the discharge mechanism unit 25 is discharged to the outside of the housing 12 from the medium discharge port 26 formed in the housing 12. That is, the medium discharge port 26 becomes the downstream end of the medium transport path 20, that is, the furthest downstream of the transport path of the medium. The sheet P discharged from the medium discharge port 26 is mounted on a mounting stand 60 in a layered state as shown by the double dotted and dashed line in FIG. 1.

The feeding mechanism unit 30 includes a first medium supply unit 21, a second medium supply unit 22, a third medium supply unit 23, and an electrostatic transport unit 50. The electrostatic transport unit 50 is arranged directly below the printing unit 14 in the drawing. That is, ink is discharged from the print head 141 to the sheet P transported by the electrostatic transport unit 50.

An openable/closeable cover 12F is provided on one side surface (right side surface in FIG. 1) of the housing 12, and an insertion port 12*a* is exposed by the cover 12F being opened. The first medium supply unit 21 includes a first feed roller pair 41 that pinch the sheet P inserted in the housing 12 from the insertion port 12*a* exposed in this way. The sheet P is fed toward the electrostatic transport unit 50 by the rotation of the two rollers that configure the first feed roller pair 41.

A medium cassette 12*c* in which the sheets P prior to printing are set in a stacked state is provided on the lower portion in FIG. 1 of the housing 12. The second medium supply unit 22 is a supply unit for feeding the sheet P from the medium cassette 12*c*. That is, the second medium supply unit 22 includes a pick-up roller 16*a* that delivers the uppermost sheet P in the medium cassette 12*c* to outside the medium cassette 12*c*, an isolation roller pair 16*b* that prevents a plurality of sheets P from being overlapped and transported, and a second feed roller pair 42 that pinches one sheet P passing through the isolation roller pair 16*b*. The sheet P is fed toward the electrostatic transport unit 50 by the rotation of the two rollers that configure the second feed roller pair 42.

The third medium supply unit 23 is a supply unit for guiding again the sheet P with printing on the sheet surface of one side (first surface) is completed to the electrostatic transport unit 50 when performing duplex printing in which printing is performed with respect to the sheet P on the sheet surface of both sides. That is, a branch transport path 24 that branches from the medium transport path 20 is formed further downstream in the transport direction of the sheet than the electrostatic transport unit 50. A branching mechanism 27 that is arranged further to the downstream in the transport direction of the sheet than the electrostatic transport unit 50 and that switches the transport path of the sheet P to the medium transport path 20 or the branch transport path 24 and a branch transport path roller pair 44 that is arranged on the branch transport path 24, and that is capable of rotation in the forward and reverse directions are provided in the third medium supply unit 23.

In a case of performing duplex printing, the sheet P with printing completed on a sheet surface on one side is guided from the electrostatic transport unit 50 to the branch transport path 24 by the branching mechanism 27. At this time, the sheet P is transported to the downstream in the transport direction by the rotation in the forward direction of each roller that configures the branch transport path roller pair 44. When the tail end of the sheet P is guided to the branch transport path 24, each roller that configures the branch transport path roller pair 44 rotates in the reverse direction and the sheet P is transported in the reverse direction. Thus, the sheet P is guided to the reverse supply path 31 that is positioned further upwards than the printing unit 14 in FIG. 1. The sheet P is fed along the reverse supply path 31 by the rotation of the plurality of reverse transport roller pairs 45 arranged on the reverse supply path 31. In so doing, the sheet P merges into the medium transport path 20 further upstream in the transport direction of the sheet than the electrostatic transport unit 50. Thereafter, the sheet P is guided again to the electrostatic transport unit 50.

When the sheet P is guided again to the electrostatic transport unit 50 in this way, the sheet surface (first surface) on which printing is completed comes in contact with the electrostatic transport unit 50, and the sheet surface (second surface) that is not printed faces the print head 141. The sheet surface from both surfaces of the sheet P that comes in contact with the electrostatic transport unit 50 is referred to as the "contact surface" and the surface on the opposite side to the contact surface is referred to as the "printing surface". That is, in the printing apparatus 11 of the embodiment, after printing on the first surface from both surfaces of the sheet P by the third medium supply unit 23 is finished, an example of the "reversal mechanism" that reverses the front and back of the sheet P and guides the sheet P to the electrostatic transport unit 50 is configured so that the first surface becomes the contact surface and the second surface becomes the printing surface.

Figure 2A:
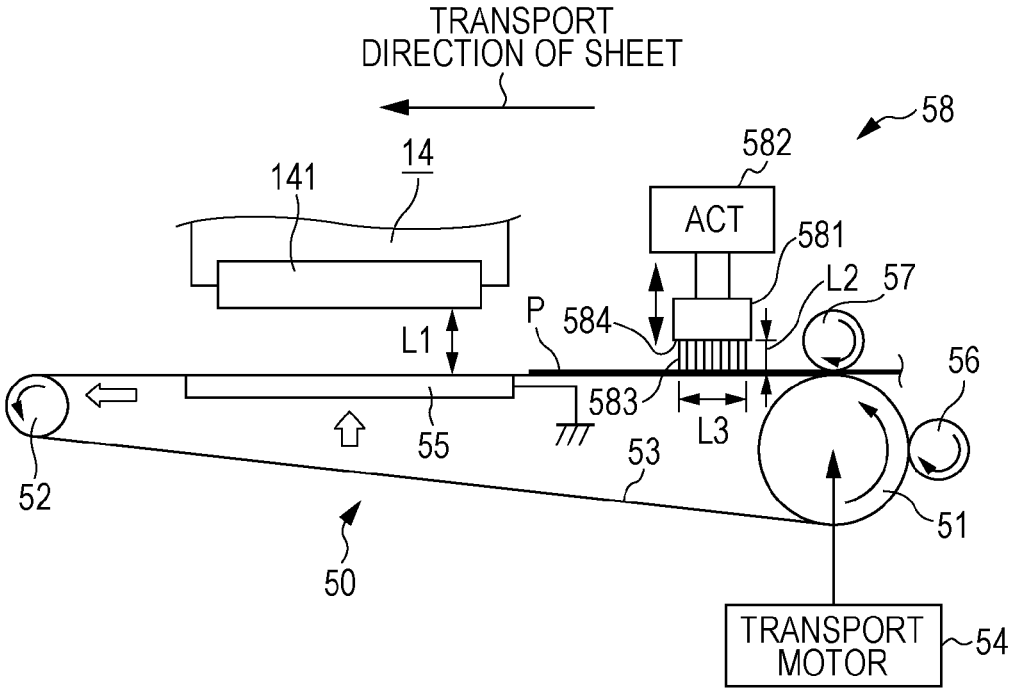
FIG. 2A is a schematic view illustrating a configuration of an electrostatic feeding unit and peripheral members thereof of the printing apparatus.
Figure 2B:
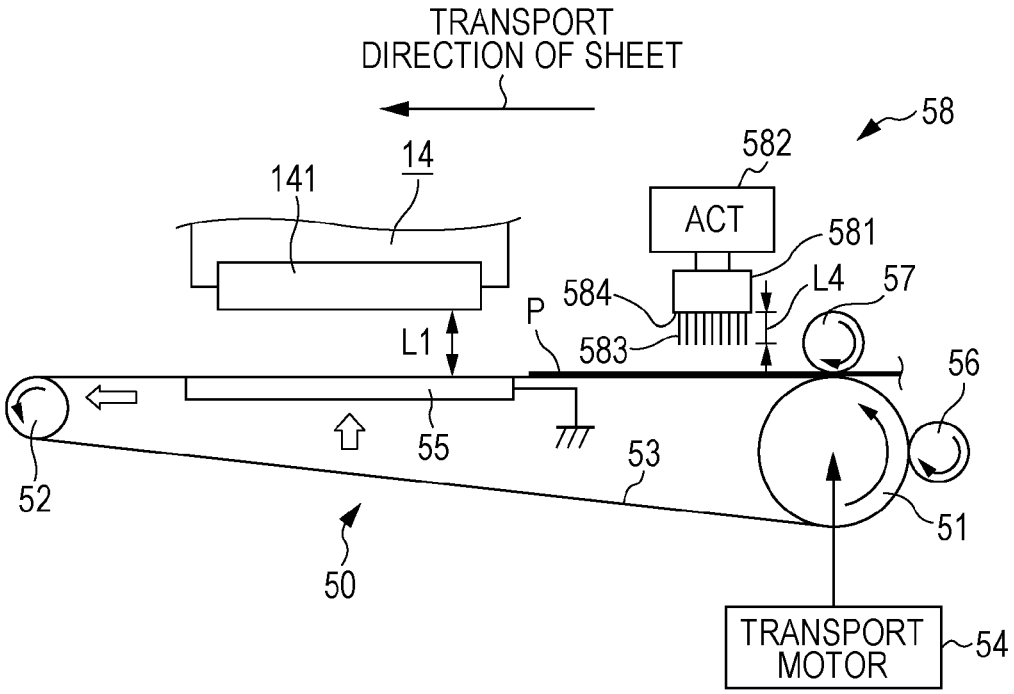
FIG. 2B is a schematic view illustrating the configuration of the electrostatic feeding unit and peripheral members thereof of the printing apparatus.

Next, the configuration of the electrostatic transport unit 50 and peripheral members thereof will be described with reference to FIGS. 2A to 2B. As shown in FIGS. 2A and 2B, the electrostatic transport unit 50 includes a transport driving roller 51 arranged further upstream (that is, right side in the drawing) in the transport direction of the sheet than the print head 141, and a transport driven roller 52 arranged further to the downstream (that is, left side in the drawing) in the transport direction of the sheet than the print head 141. An endless transport belt 53 is suspended on each of these rollers 51 and 52. The transport driven roller 52 is biased in a direction (leftward in the drawing) separated from the transport driving roller 51, as shown by the arrow in FIG. 2A. The transport belt 53 is operated and the sheet P is transported to the downstream in the transport direction by driving of the transport motor 54 being transmitted to the transport driving roller 51. That is, the outer surface of the transport belt 53 functions as a support surface that comes in contact with the contact surface of the sheet P.

A backup plate 55 made from metal that passes through the transport belt 53 to support the sheet P is provided directly below the print head 141. The backup plate 55 is grounded. The backup plate 55 is comes in contact with the inner surface of the transport belt 53 that is the surface on the opposite side to the support surface of the transport belt 53, and biases the transport belt 53 to the print head 141 side.

A charging roller 56 that is an example of a charging unit is provided further to the upstream in the transport direction (right side in the drawing) than the transport driving roller 51. The charging roller 56 comes in contact with to the outer surface of the transport belt 53. The charging roller 56 is driven to rotate with respect to the transport driving roller 51 by the rotation of the transport driving roller 51 being transmitted to the charging roller 56 through the transport belt 53. At this time, the contact location on the transport belt 53 is charged by the charging roller 56 applying a voltage to the contact location on the outer surface of the transport belt 53. That is, the transport belt 53 is charged by contact with the charging roller 56. In the printing apparatus 11 of the embodiment, the charging roller 56 alternately supplies a positive charge or a negative charge with respect to the transport belt 53 that is in contact with the charging roller 56.

A support roller 57 that pushes the sheet P fed by the electrostatic transport unit 50 to the transport belt 53 is provided further to the upstream in the transport direction of the sheet (right side in the drawing) than the print head 141. The support roller 57 is configured from a conductive material, such as a metal, and is grounded. The support roller 57 is driven to rotate with respect to the transport driving roller 51 by the rotation of the transport driving roller 51 being transmitted to the support roller 57 through the transport belt 53.

A charge eliminating device 58 is further provided between the support roller 57 and the print head 141 in the transport direction of the sheet. The charge eliminating device 58 includes a charge eliminating unit 581 configured by a brush 583 or the like and an actuator 582 that causes the charge eliminating unit 581 to be displaced. The charge eliminating unit 581 extends in an extension direction for which the width direction of the sheet is the main component and is able to contact all regions in the width direction of the sheet. When the charge eliminating unit 581 comes in contact with the printing surface of the sheet P transported by the transport belt 53, the charge eliminating unit 581 eliminates the charge from the printing surface.

The charge eliminating unit 581 is displaceable between a charge elimination position that is a position able to come in contact with the sheet P and a retreated position that is a position unable to come in contact with the sheet P by the driving of the actuator 582. That is, as indicated by the arrow, the charge eliminating unit 581 is displaceable in a direction orthogonal to the printing surface of the sheet P, and the position of the charge eliminating unit 581 shown in FIG. 2A is the charge elimination position, and the position of the charge eliminating unit 581 shown in FIG. 2B is the retreated position.

In the embodiment, the distance L1 between the print head 141 and the transport belt 53 in the direction (direction orthogonal to the printing surface of the sheet P) in which ink is discharged from the print head 141 is 0.9 mm.

In a state in which the brush 583 presses the sheet P adsorbed on the transport belt 53 with the charge eliminating unit 581 in FIG. 2A at the charge elimination position, the distance L2 of the brush 583 from the support surface 584 to the sheet P in a direction orthogonal to the printing surface of the sheet P is 5.5 mm, and the distance L3 in a range in which the brush 583 abuts on the transport belt 53 in the transport direction (left-to-right direction in the drawing) is 8 mm.

In a state in which the brush 583 is separated from the transport belt 53 with the charge eliminating unit 581 in FIG. 2B is at the retreated position, the length L4 of the brush 583 that is upright from the support surface 584 in a direction orthogonal to the printing surface of the sheet P is 6.5 mm.

Next, the action when the sheet P is electrostatically adsorbed on the transport belt 53 will be described with reference to FIGS. 3A and 3B.

Figure 3A:
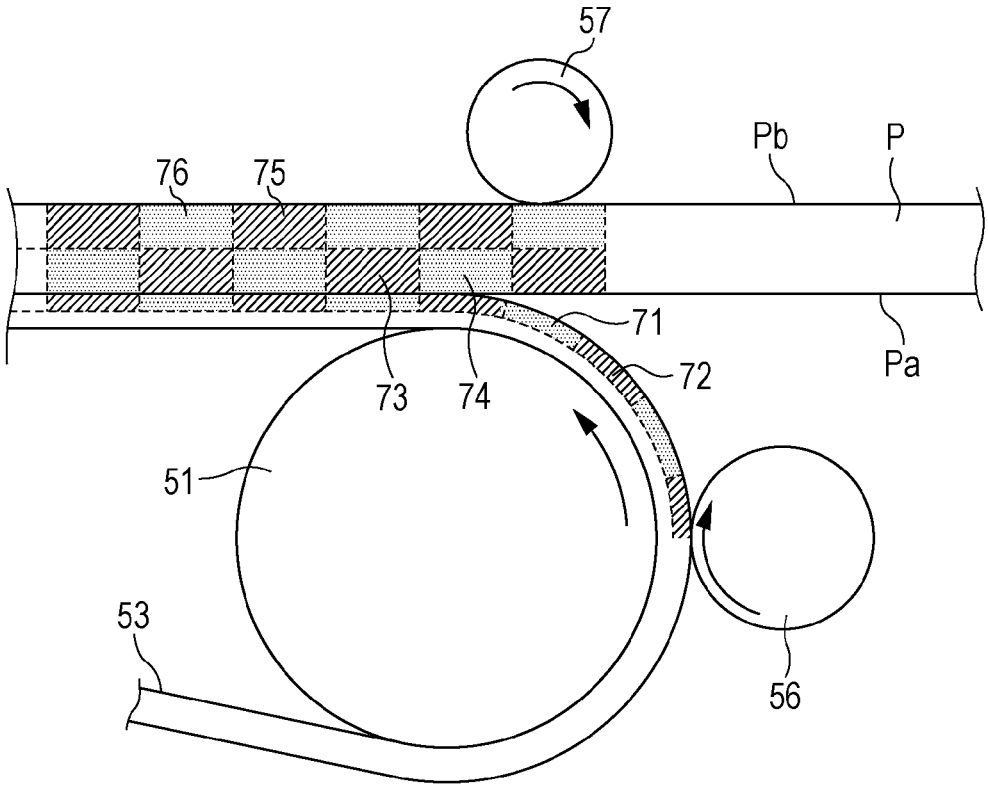
FIG. 3A is an operation diagram illustrating a condition in which a sheet is electrostatically adsorbed on a transport belt.
Figure 3B:
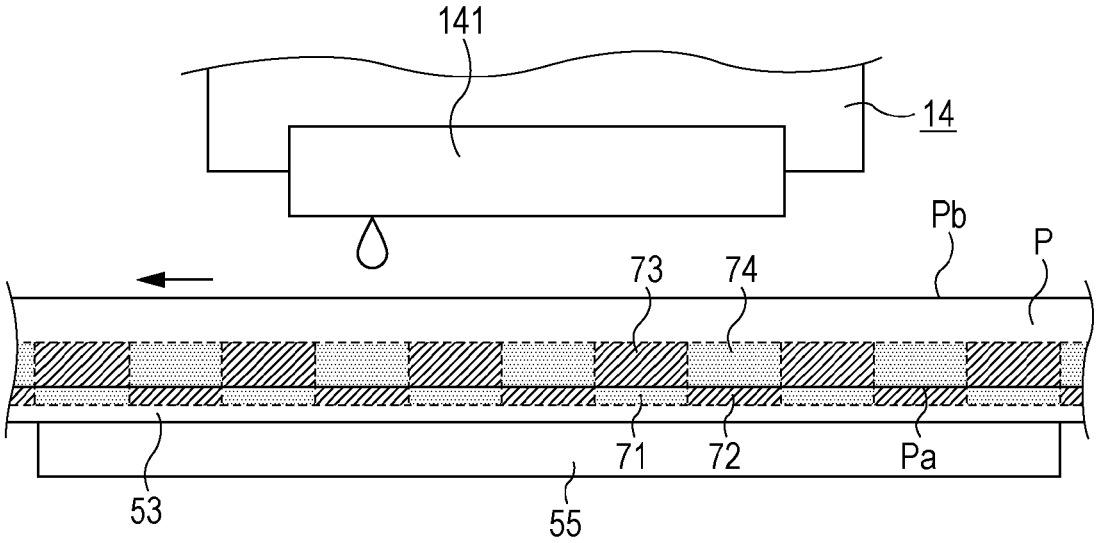
FIG. 3B is an operation diagram illustrating a condition in which the sheet is electrostatically adsorbed on the transport belt.

As shown in FIG. 3A, when the transport belt 53 is operated by the rotation of the transport driving roller 51, a positive part 71 that is a part at which a positive charge is charged on the outside of the transport belt 53 and a negative part 72 that is a part at which a negative charge is charged are alternately formed by the charging roller 56 being driven to rotate. When the sheet P is pressed by the support roller 57 to the outer surface of the transport belt 53 in this way, the sheet P is in tight contact with the transport belt 53, and polarization occurs in the sheet P. That is, while the part that faces the positive part 71 of the transport belt 53 in the contact surface Pa (lower surface in the drawing) of the sheet P is the negative part 73 charged with a negative charge, the part facing the negative part 72 of the transport belt 53 in the contact surface Pa of the sheet P is the positive part 74 charged with a positive charge. Accordingly, even in the contact surface Pa of the sheet P, the positive part 74 and the negative part 73 are alternately formed.

Also in the printing surface Pb of the sheet P that is the opposite side of contact surface Pa, the negative part 75 charged with a negative charge and the positive part 76 charged with a positive charge are alternately formed. In a case where the resistance value of the sheet P is low, even if the charge eliminating unit 581 is not brought into contact with printing surface Pb, in the printing surface Pb, the charge is naturally easily neutralized by the positive part 76 and the negative part 75 being adjacent to one another. Therefore, as shown in FIG. 3B, the charge of the printing surface Pb is substantially eliminated until the sheet P reaches directly under the print head 141.

However, in a case where the resistance value of the sheet P is high, in the printing surface Pb, it is difficult for the charge to be neutralized naturally by the positive part 76 and the negative part 75 adjacent to one another. In this case, the charge on the printing surface Pb side and the charge on the contact surface Pa side become attracted to one another. The attractive force that is a force arising due to the attraction between the charge on the printing surface Pb side and the charge on the contact surface Pa side is a force that causes the contact surface Pa to be drawn to the printing surface Pb side. That is, the attractive force becomes a repulsive force with respect to the force that attracts the contact surface Pa of the sheet P to the transport belt 53. Therefore, the force that attracts the sheet P to the transport belt 53, that is, the electrostatic adsorption force does not easily increase. Accordingly, in a case where the resistance value of the sheet P is predicted to be large, it is possible for the electric charge to be substantially eliminated from the printing surface Pb by the charge eliminating unit 581 being made to come in contact with printing surface Pb. In so doing, the attractive force is reduced, and the electrostatic adsorption force of the sheet P due to the transport belt 53 increases.

Incidentally, in a case where the charge eliminating unit 581 is arranged at the charge elimination position, the support roller 57 and the charging roller 56 are different, and the charge eliminating unit 581 is not driven to rotate with respect to the operation of the transport belt 53. Therefore, deterioration of the charge eliminating unit 581 stemming from contact with the transport belt 53 and the sheet P proceeds more easily than the support roller 57 and the charging roller 56. The elimination efficiency of the electric charge from the sheet P by the charge eliminating unit 581 is lowered as the deterioration of the charge eliminating unit 581 progresses in this way.

Here, it is possible to determine whether the resistance value of the sheet P that is the printing target is high in light of the type of sheet P, that is, the constitution of the sheet, the weight of the sheet, the thickness of the sheet and the like. For example, it is possible for the type of sheet P that is the printing target to be selected with the user interface of the printing apparatus 11 or an external apparatus (personal computer or mobile terminal) that is able to communicate with the printing apparatus 11 and to determine whether the resistance value of the sheet P that is the printing target is high by analyzing the information according to the selection results thereof with a control device.

Here, in the printing apparatus 11 of the embodiment, while the charge eliminating unit 581 is arranged at the retreated position when printing on the sheet P when it is possible to determine that the resistance value of the printing target sheet P is low, the charge eliminating unit 581 is arranged at the charge elimination position when printing on the sheet P when it is possible to determine that the resistance value of the printing target sheet P is high.

Even with the same type of sheet P, the resistance value of the sheet P is able to change due to the installation environment and the like of the printing apparatus 11. That is, in a case where the temperature TMP of the installation environment of the printing apparatus 11 is constant, the resistance value of the sheet P decreases as the humidity HMD of the installation environment increases. In a case where the humidity HMD of the installation environment of the printing apparatus 11 is constant, the resistance value of the sheet P decreases as the temperature TMP of the installation environment increases.

Figure 4:
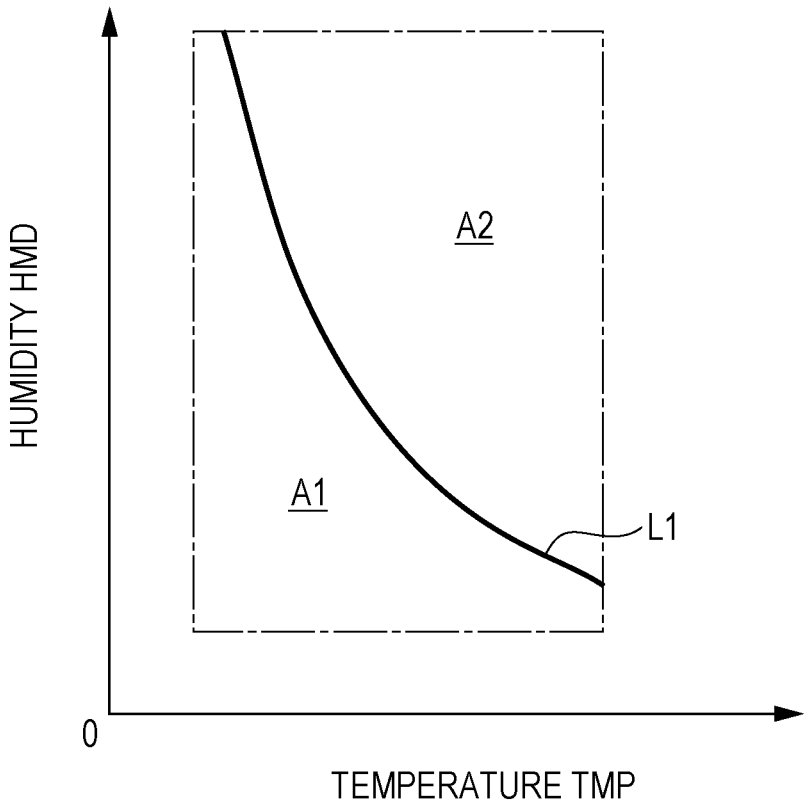
FIG. 4 is a map for determining whether a resistance value of the sheet is increased based on the temperature and humidity of the installation environment of the printing apparatus.

FIG. 4 illustrates an example of a map for determining whether the resistance value of the sheet P increases based on the relationship between the temperature TMP and the humidity HMD of the installation environment. As shown in FIG. 4, in a case where the points indicating the temperature TMP and the humidity HMD of the installation environment are included in the high resistance region A1 that is the region further to the lower left than the boundary line L1, it is possible to determine that the resistance value of the sheet P is increasing. Meanwhile, in a case where the points indicating the temperature TMP and the humidity HMD of the installation environment are included in the low resistance region A2 that is the region further to the upper right than the boundary line L1, it is possible to determine that the resistance value of the sheet P is decreasing.

Here, in the printing apparatus 11 of the embodiment, the charge eliminating unit 581 is arranged at the retreated position when printing on the sheet P when it is possible to determine that the resistance value of the printing target sheet P is low based on the temperature TMP and humidity HMD of the installation environment. Meanwhile, the charge eliminating unit 581 is arranged at the charge elimination position when printing on the sheet P when it is possible to determine that the resistance value of the printing target sheet P is high based on the temperature TMP and humidity HMD of the installation environment.

Incidentally, when curling occurs in the sheet P due to the attachment of the ink, there is concern of the sheet P contacting the print head 141 or the like, the sheet P being fouled, or the sheet P receiving damage, and, as a result, printing defects occurring. Therefore, from the viewpoint of suppressing printing defects during printing on a sheet P in which curling easily occurs, it is not desirable that the electrostatic adsorption force of the sheet P due to the transport belt 53 is low. On the other hand, even if the electrostatic adsorption force of the sheet P due to the transport belt 53 is low during printing on a sheet P in which curling does not easily occur, printing defects such as above do not easily occur.

The ease with which curling occurs due to the attachment of ink to the sheet P differs according to the type of sheet P that is the printing target. In other words, it is possible to predict the ease with which curling of the sheet P that is the printing target occurs by specifying the type of sheet P. Here, by the type of the sheet P that is the printing target as above being selected and analyzing the information according to the selection results thereof with a control device, it can be determined whether curling easily occurs in the sheet P that is the current printing target with the printing apparatus 11.

Here, in the printing apparatus 11 of the embodiment, when it is possible to determine that curling easily occurs due to the attachment of ink to the sheet P that is the printing target, the charge eliminating unit 581 is arranged at the charge elimination position when printing on the sheet P. Meanwhile, when it is possible to determine that curling does not easily occur due to the attachment of ink to the sheet P that is the printing target, the charge eliminating unit 581 is arranged at the retreated position when printing on the sheet P.

Next, the control device 80 of the printing apparatus 11 will be described with reference to FIG. 5.

Figure 5:
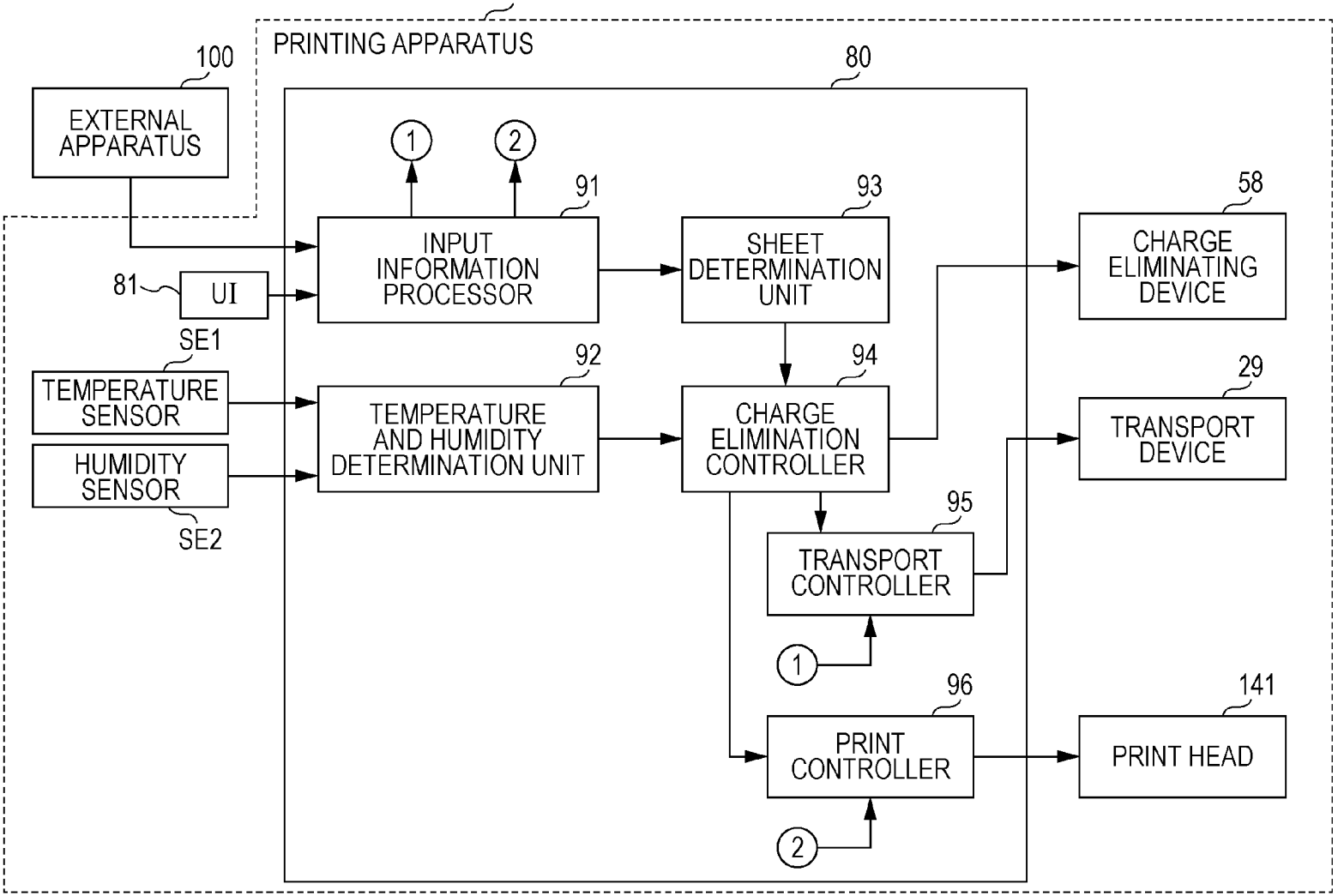
FIG. 5 is a block diagram illustrating a functional configuration of the printing apparatus.

As shown in FIG. 5, a temperature sensor SE1 that detects the temperature TMP of the installation environment of the printing apparatus 11, a humidity sensor SE2 that detects the humidity HMD of the installation environment of the printing apparatus 11, and a user interface 81 that is operated by a user are electrically connected in the control device 80. The external apparatus 100 such as a personal computer or a mobile terminal is able to communicate with the control device 80.

The control device 80 includes a microcomputer configured by a CPU, a ROM, a RAM and the like, an application specific IC (ASIC), and various driver circuits. The control device 80 includes an input information processor 91, a temperature and humidity determination unit 92, a sheet determination unit 93, a charge elimination controller 94, a transport controller 95, and a print controller 96 as functional units configured by at least one of software and hardware.

The input information processor 91 analyzes information input from the user interface 81 and information received from the external apparatus 100, and outputs, as appropriate, the analysis results thereof to the sheet determination unit 93, the transport controller 95, and the print controller 96. For example, the input information processor 91 outputs information pertaining to the type of sheet P that is the printing target to the sheet determination unit 93 and outputs information pertaining to the transport state of the sheet P to the transport controller 95. The input information processor 91 outputs the information pertaining to the printing precision to the print controller 96.

Possible examples of the information pertaining to the transport state of the sheet P include information pertaining to the transport speed of the sheet P and information on which of single sided printing or duplex printing is selected. Possible examples of the information pertaining to the printing precision include printing data that is data pertaining to an image formed on the sheet P and information pertaining to the resolution of the image formed on the printing surface of the sheet P.

The temperature and humidity determination unit 92 determines whether the environment is one in which the resistance value of the sheet P easily increases based on the temperature TMP detected by the temperature sensor SE1 and the humidity HMD detected by the humidity sensor SE2. At this time, the temperature and humidity determination unit 92, with reference to the map shown in FIG. 4, determines if the installation environment at the present point in time is included in the high resistance region A1 or is included in the low resistance region A2, and outputs the information pertaining to the determination results to the charge elimination controller 94. At this point, an example of the "determination device" that determines whether the resistance value of the sheet P that is the printing target increases based on the temperature TMP and humidity HMD of the installation environment of the printing apparatus 11 is configured by the temperature and humidity determination unit 92.

The sheet determination unit 93 determines whether the sheet P that is the printing target is a sheet with a high resistance value or is a sheet in which curling easily occurs due to the attachment of ink based on the information input from the input information processor 91. The sheet determination unit 93 outputs information pertaining to the determination results to the charge elimination controller 94.

The charge elimination controller 94 determines if the charge eliminating unit 581 is arranged at the charge elimination position or is arranged at the retreated position based on the information input from the sheet determination unit 93 and the temperature and humidity determination unit 92. That is, the charge elimination controller 94 determines whether the charge eliminating unit 581 is made to come in contact with the sheet P transported by the transport belt 53 when printing on the sheet P.

For example, the charge elimination controller 94 determines that the charge eliminating unit 581 is arranged at the charge elimination position when at least one of the following three conditions is established. Meanwhile, the charge elimination controller 94 determines that the charge eliminating unit 581 is arranged at the retreated position when none of the following three conditions is established.

case where the resistance value of the sheet P that is the printing target is determined to be high based on the input information from the sheet determination unit 93.

case where the sheet P that is the printing target is determined to be a sheet that easily curls based on the input information from the sheet determination unit 93.

case where the installation environment of the printing apparatus 11 at the present point in time is included in the high resistance region A1 based on the input information from the temperature and humidity determination unit 92.

In a case where the charge elimination controller 94 determines that the charge eliminating unit 581 is arranged at the charge elimination position, the charge elimination controller 94 arranges the charge eliminating unit 581 at the charge elimination position by the actuator 582 being driven when the sheet P transported while electrostatically adsorbed on the transport belt 53 is at a position able to come in contact with the charge eliminating unit 581. Meanwhile, in a case where the charge elimination controller 94 determines that the charge eliminating unit 581 is arranged at the retreated position, the charge elimination controller 94 arranges the charge eliminating unit 581 at the retreated position by the actuator 582 being driven. At this point, in the printing apparatus 11 of the embodiment, an example of the "charge elimination control device" that controls the position of the charge eliminating unit 581 is configured by the charge elimination controller 94. When the position control of the charge eliminating unit 581 is completed in this way, the charge elimination controller 94 outputs that the start of printing on the sheet P is allowed to the transport controller 95 and the print controller 96.

When it is input from the charge elimination controller 94 that the start of printing is allowed, the transport controller 95 controls the transport device 29 so that the sheet P is transported in a state based on the input information from the input information processor 91.

The print controller 96 controls the form of ink discharged from the print head 141 based on the printing data. At this time, it is possible for the print controller 96 to form the image at an appropriate position on the printing surface Pb of the sheet P by cooperating with the transport controller 95.

Next, the processing procedure when executing printing on the sheet P will be described with reference to the flowchart shown in FIG. 6.

Figure 6:
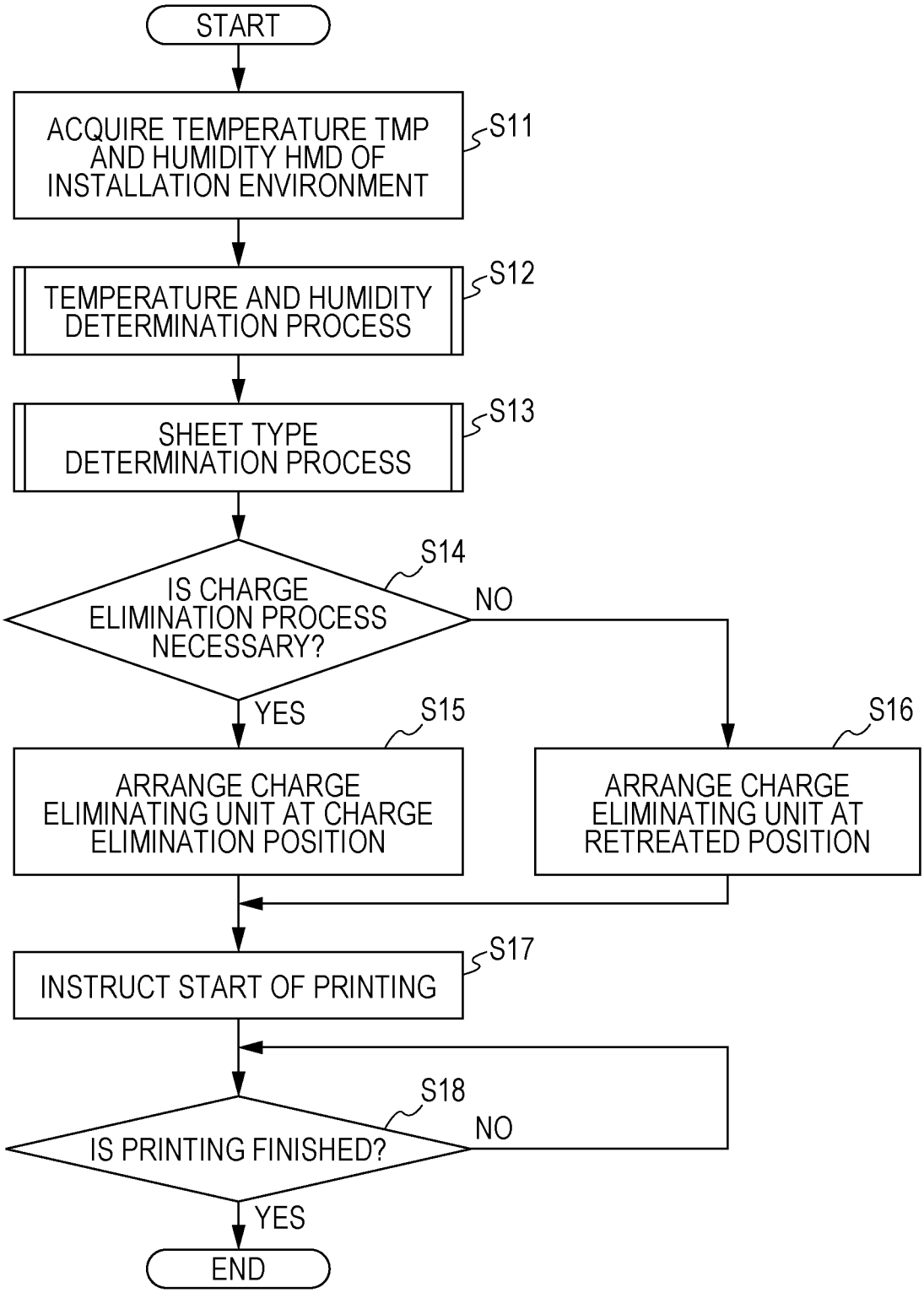
FIG. 6 is a flowchart illustrating a processing procedure when performing printing on the sheet in the printing apparatus.

As shown in FIG. 6, firstly, in step S11, the temperature TMP and humidity HMD of the installation environment of the printing apparatus 11 is acquired. In the next step S12, the temperature and humidity determination process is executed. The temperature and humidity determination process is executed by the temperature and humidity determination unit 92. That is, whether the installation environment at the present point in time indicated by the acquired temperature TMP and humidity HMD is included in the high resistance region A1 or is included in the low resistance region A2 is determined. When the temperature and humidity determination process is finished, the process transitions to the next step S13.

In the step S13, the sheet type determination process is executed. The sheet type determination process is executed by the sheet determination unit 93. That is, whether the sheet P that becomes the printing target is a sheet with a high resistance value is determined based on the information pertaining to the type of sheet P input to the sheet determination unit 93. Based on the information, whether the sheet P that is the printing target is a sheet in which curling easily occurs due to the attachment of ink is determined. When the sheet type determination process is finished, the process transitions to the next step S14.

In the step S14, it is determined whether execution of the charge elimination process that eliminates the charge from the printing surface Pb of the sheet P is necessary for the current printing. The determination is executed by the charge elimination controller 94. In a case where execution of the charge elimination process is determined to be necessary, it is determined to arrange the charge eliminating unit 581 at the charge elimination position. Meanwhile, in a case where execution of the charge elimination process is determined to be unnecessary, it is determined to arrange the charge eliminating unit 581 at the retreated position.

In a case where it is determined that execution of the charge elimination process is necessary (step S14: YES), the charge eliminating unit 581 is arranged at the charge elimination position (step S15), and the process transitions to the step S17, described later. Meanwhile, in a case where it is determined that execution of the charge elimination process is unnecessary (step S14: NO), the charge eliminating unit 581 is arranged at the retreated position (step S16), and the process transitions to the next step S17.

In the step S17, when the position control of the charge eliminating unit 581 is completed, the transport controller 95 and the print controller 96 are instructed to start printing. Thus, the transport device 29 and the printing unit 14 are driven, the sheet P is transported, and ink is discharged from the print head 141 to the printing surface Pb of the sheet P electrostatically adsorbed on the transport belt 53.

In the step S18, it is determined whether printing on the sheet P is completed. In a case where the printing is not yet completed (step S18: NO), printing on the sheet P is continued. Meanwhile, in a case where the printing is completed (step S18: YES), the sheet P is discharged toward the mounting stand 60 by the transport device 29, and the present process is completed.

Above, according to the printing apparatus 11 of the embodiment, it is possible to obtain the following effects.

(1) In the printing apparatus 11 of the embodiment, arranging the charge eliminating unit 581 at the charge elimination position or at the retreated position is possible. Therefore, it is possible for the charge eliminating unit 581 to be caused to come in contact with sheet P electrostatically adsorbed on the transport belt 53, and for the charge eliminating unit 581 to not be allowed to come in contact with sheet P. Therefore, it is possible for the chance of the charge eliminating unit 581 being made to come in contact with sheet P or the transport belt 53 when printing to be reduced, compared to a case where the charge eliminating unit 581 is constantly arranged at the charge elimination position. As a result, deterioration of the charge eliminating unit 581 is delayed and it is possible to suppress lowering of the elimination efficiency of the electric charge from the sheet P by the charge eliminating unit 581.

(2) For example, whether the charge eliminating unit 581 is arranged at the charge elimination position or arranged at the retreated position is determined according to the type of sheet P that is the printing target, and the position of the charge eliminating unit 581 is controlled based on the determination results. In so doing, it is possible for contact between the sheet P and the charge eliminating unit 581 to be avoided when it is possible to determine that the electrostatic adsorption force of the sheet P may not increase due to the transport belt 53. Therefore, the charge eliminating unit 581 does not easily deteriorate compared to a case where the charge eliminating unit 581 is constantly arranged at the charge elimination position by the amount that is it possible to arrange the charge eliminating unit 581 at the retreated position during printing according to the type of sheet P that is the printing target. As a result, it is possible for lowering of the elimination efficiency of the electric charge from the sheet P by the charge eliminating unit 581 to be suppressed.

(3) It is determined whether the resistance value of the sheet P is increased based on the temperature TMP and humidity HMD of the installation environment of the printing apparatus 11, and the charge eliminating unit 581 is caused to come in contact with sheet P transported by the transport belt 53 when it is possible to determine that the resistance value is increased. Conversely, the charge eliminating unit 581 is not brought into contact with sheet P transported by the transport belt 53 when it is possible to determine that the resistance value of the sheet P is decreased. That is, because the electrostatic adsorption force of the sheet P due to the transport belt 53 is comparatively large when it is possible to predict that the electric charge of the printing surface Pb is easily naturally neutralized even if the electric charge is not eliminated from the printing surface Pb of the sheet P by the charge eliminating unit 581, the charge eliminating unit 581 does not come in contact with the sheet P. Therefore, it is possible for the chance of the charge eliminating unit 581 being caused to come in contact with sheet P or the transport belt 53 to be reduced, compared to a case where the charge eliminating unit 581 is constantly arranged at the charge elimination position regardless of the temperature and humidity of the installation environment of the printing apparatus 11. Accordingly, it is possible to delay deterioration of the charge eliminating unit 581, and it is possible to suppress lowering of the elimination efficiency of the electric charge from the sheet P due to the charge eliminating unit 581.

(4) It is possible to reduce the exchange frequency of the charge eliminating unit 581 by lowering of the elimination efficiency of the electric charge from the sheet P due to the charge eliminating unit 581 in this way being suppressed.

(5) The sheet P fed to the electrostatic transport unit 50 is pressed to the transport belt 53 by the support roller 57. In this way, it is possible for the adhesiveness between the sheet P and the transport belt 53 to be increased, and the sheet P is easily polarized. As a result, it is possible to increase the electrostatic adsorption force of the sheet P due to the transport belt 53.

(6) The metal backup plate 55 comes in contact with the inner surface that is the surface on the opposite side to the outer surface that the sheet P comes in contact with the transport belt 53. Because the backup plate 55 is grounded, it is possible to eliminate the electric charge charged to the inner surface side of the transport belt 53 by the backup plate 55. Therefore, it is possible for the electrostatic adsorption force of the sheet P due to the transport belt 53 to be increased by the amount it is possible to suppress the reduction in the amount of electric charge charged to the outer surface side of the transport belt 53.

Second Embodiment

Next, a second embodiment in which the printing apparatus 11 is exemplified will be described according to FIGS. 7 to 9. In the second embodiment, the feature of determining whether the charge eliminating unit 581 is arranged at the charge elimination position or is arranged at the retreated position during printing on the second surface during duplex printing differs from the first embodiment. Accordingly, in the following description, the parts different from the first embodiment are mainly described, the same members and configurations as the first embodiment are given the same reference numbers, and overlapping description thereof will not be provided.

Ink is not yet attached to the sheet P during printing on the first surface of the sheet P when performing duplex printing. Meanwhile, the ink is already attached to the first surface during printing on the second surface of the sheet P, and there is concern of curling of the sheet P according to the attachment form of the ink to the first surface.

In this way, when transported to directly below the print head 141 in a state in which the sheet P is curled, there is concern of the part of the sheet P that is curled contacting the print head 141 or the like.

Here, in the printing apparatus 11 of the embodiment, it is determined whether there is potential for the sheet P to curl based on the form of printing on the first surface, and, when it is determined that there is potential of curling, the charge eliminating unit 581 is arranged at the charge elimination position when performing printing on the second surface. In so doing, when the sheet P for which printing on the second surface is to be performed is transported by the transport belt 53, the charge eliminating unit 581 comes in contact with the second surface of the sheet P and the electric charge is eliminated from the second surface. As a result, because it is possible to increase the electrostatic adsorption force of the sheet P due to the transport belt 53, curling of the sheet P can be suppressed on the transport belt 53.

On the other hand, when it is determined that the sheet P does not curl even when printing is performed on the first surface, the charge eliminating unit 581 is arranged at the retreated position when performing printing on the second surface. In so doing, it is difficult for deterioration of the charge eliminating unit 581 to progress compared to cases where the charge eliminating unit 581 is constantly arranged at the charge elimination position when performing duplex printing.

In the printing apparatus 11 of the embodiment, during printing on the first surface when performing duplex printing and during printing on one side only, the charge eliminating unit 581 is arranged at the retreated position. Also on this point, it is possible for the progress of the deterioration of the charge eliminating unit 581 to be delayed.

Next, the processing procedure when executing duplex printing will be described with reference to the flowchart shown in FIG. 7.

Figure 7:
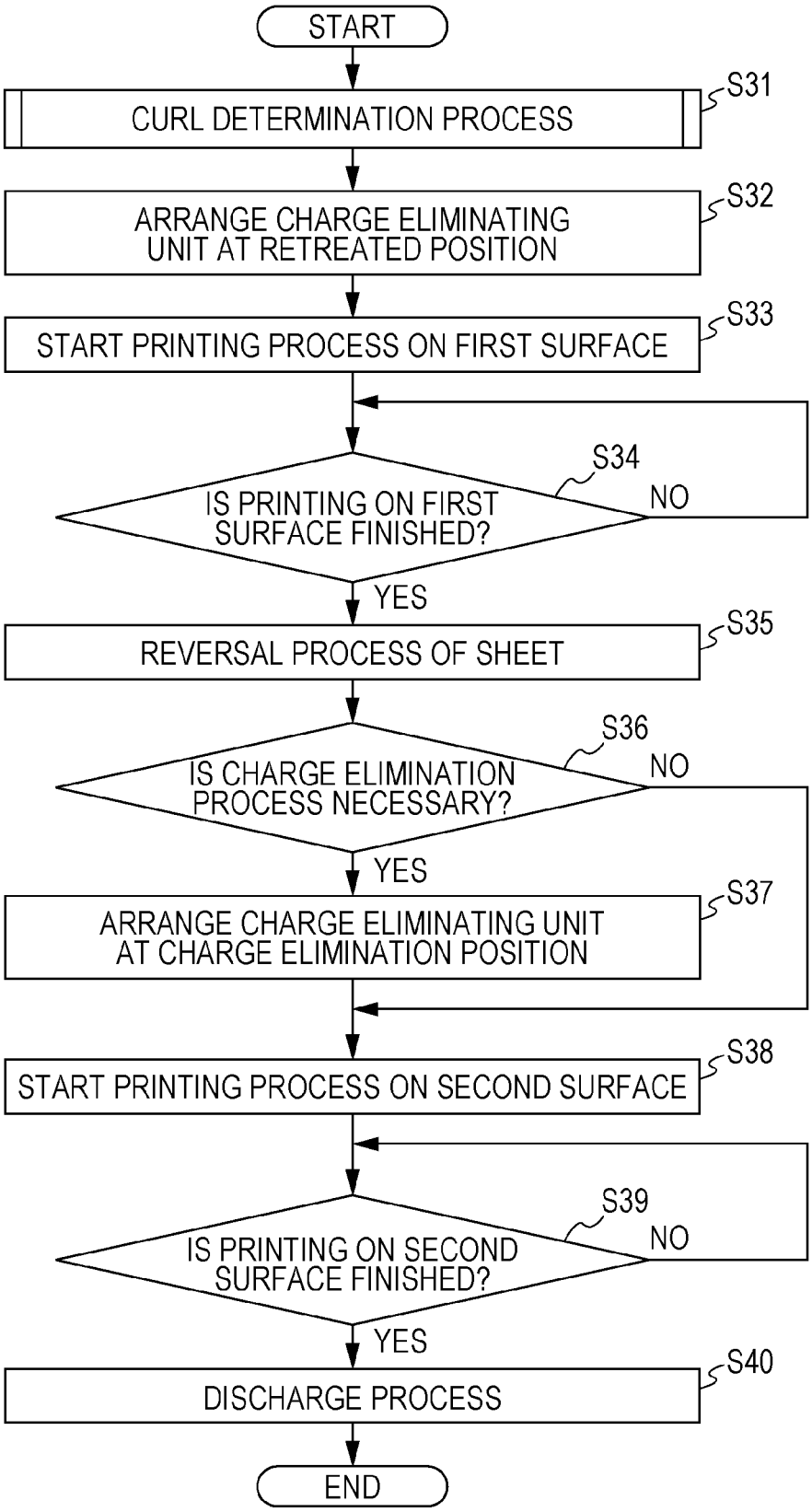
FIG. 7 is a flowchart illustrating a processing procedure when performing printing on the sheet in the printing apparatus of a second embodiment.

As shown in FIG. 7, first, in step S31, a curl determination process that determines whether there is potential for the sheet P to curl due to printing on the first surface of the sheet P is executed. The curl determination process is executed by the charge elimination controller 94. The curl determination process will be described in detail later using FIGS. 8 and 9.

In the next step S32, the charge eliminating unit 581 is arranged at the retreated position before the start of printing on the first surface of the sheet P. The printing process with respect to the first surface is started in this state (step S33). Therefore, during printing on the first surface, the charge eliminating unit 581 does not come in contact with the sheet P transported by the transport belt 53.

Next, in the step S34, it is determined whether the printing process with respect to the first surface is finished. In a case where the printing process with respect to the first surface is not yet finished (step S34: NO), the printing process is continued. Meanwhile, in a case where the printing process with respect to the first surface (step S34: YES), the process transitions to the next step S35.

In the step S35, the reversal process that again guides the sheet P reversed front to back on the transport belt 53 is executed by the third medium supply unit 23 being operated. When the sheet P is again guided to the transport belt 53 by the reversal process being executed, the second surface becomes the printing surface Pb and the first surface becomes the contact surface Pa. In so doing, printing on the second surface is possible.

In the next step S36, it is determined whether execution of the charge elimination process that eliminates the electric charge from the second surface with the charge eliminating unit 581 is necessary during printing on the second surface. That is, it is determined that execution of the charge elimination process is necessary when it is possible to determine that there is potential for the sheet P to curl due to the attachment of ink to the first surface, based on the execution results of the curl determination process in step S31. Meanwhile, it is determined that execution of the charge elimination process is unnecessary when it is possible to determine that the sheet P is not curled even when ink is attached to the first surface. Whereas it is determined to arrange the charge eliminating unit 581 at the charge elimination position when it is determined that execution of the charge elimination process is necessary, it is determined to arrange the charge eliminating unit 581 at the retreated position when it is determined that execution of the charge elimination process is unnecessary.

Therefore, in a case where it is determined that execution of the charge elimination process is unnecessary (step S36: NO), the position of the charge eliminating unit 581 is not caused to move, that is, the charge eliminating unit 581 maintains the state of being arranged at the retreated position, and the process transitions to the step S38, described later. Meanwhile, in a case where it is determined that execution of the charge elimination process is necessary (step S36: YES), the charge eliminating unit 581 is moved to the charge elimination position (step S37). The process transitions to the next step S38. Displacement of such a charge eliminating unit 581 is performed while the third medium supply unit 23 is feeding the sheet P onto the transport belt 53.

In step S38, the printing process with respect to the second surface is started. Next, in the step S39, it is determined whether the printing process with respect to the second surface is finished. In a case where the printing process with respect to the second surface is not yet finished (step S39: NO), the printing process is continued. Meanwhile, in a case where the printing process with respect to the second surface is finished (step S39: YES), the sheet P is discharged toward the mounting stand 60 by the transport device 29 (steps S40). Thereafter, the present process is finished.

Next, an example of the curl determination process (step S31) in FIG. 7 will be described with reference to the flowchart illustrated in FIG. 8 and the schematic view illustrated in FIG. 9. The curl determination process is a process executed by the charge elimination controller 94.

Figure 8:
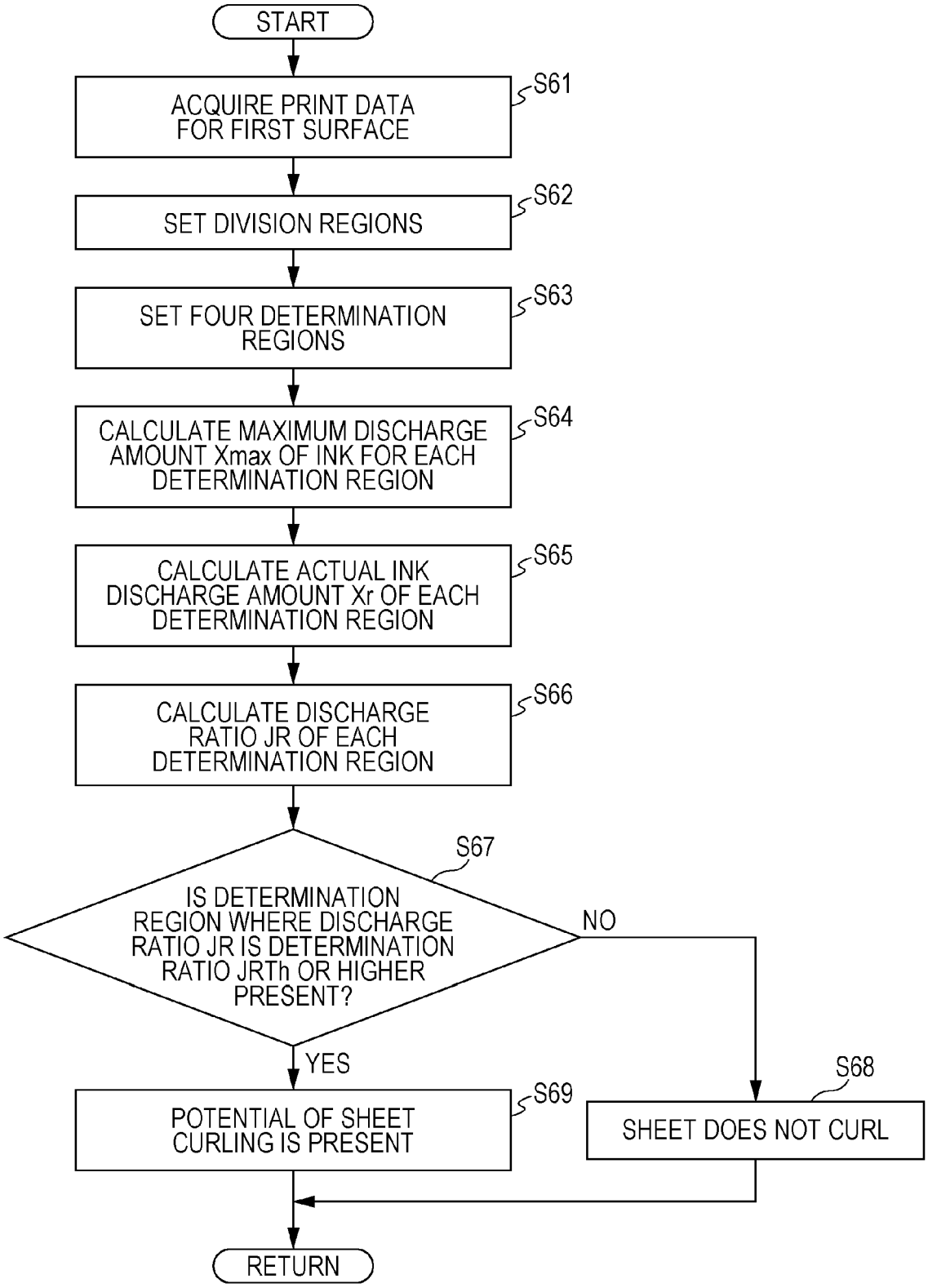
FIG. 8 is a flowchart illustrating a processing procedure for determining whether there is potential for the sheet to curl due to printing on the first surface, in the printing apparatus.

As shown in FIG. 8, the printing data for forming an image on the first surface is acquired (step S61). In the next step S62, the first surface of the sheet P is divided into a plurality of regions, and a plurality of division regions R1, R2, R3, R4, R5, R6, R7, R8, and R9 is set.

Here, an example of a method of setting the division regions R1 to R9 will be described with reference to FIG. 9. As shown in FIG. 9, the sheet P is substantially rectangular, and includes four lateral edges PE1, PE2, PE3, and PE4. Therefore, the sheet P includes four corners PK1, PK2, PK3, and PK4 that are connection parts of two lateral edges, and each of these corners PK1 to PK4 forms a substantially right angle. On the first surface of the sheet P, nine division regions R1 to R9 are set. By dividing the first surface into three along the transport direction Y of the sheet, and dividing the first surface into three along the width direction Z of the sheet, a total of nine division regions R1 to R9 are set.

Figure 9:
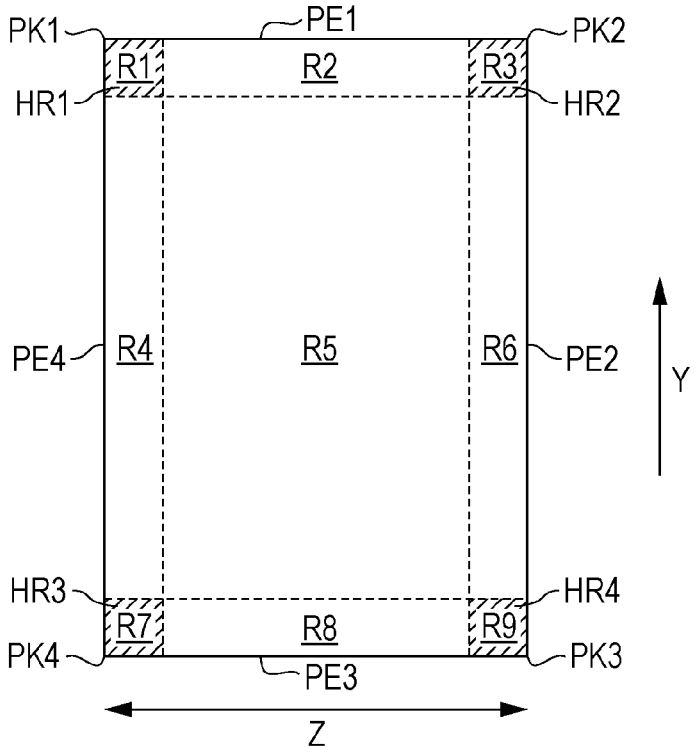
FIG. 9 is a schematic view for illustrating a condition in which a determination region is set on the first surface of the sheet, in the printing apparatus.

In the example shown in FIG. 9, regions with wide and narrow areas are mixed in the nine division regions R1 to R9. However, there is no limit thereto, and all of the areas of the division regions R1 to R9 may be equal.

Returning to FIG. 8, in the next step S63, four determination regions HR1, HR2, HR3, and HR4 are set from each of the set division regions R1 to R9. That is, the division regions that include the corners PK1 to PK4 from the nine division regions R1 to R9 shown in FIG. 9 are the determination regions. In this case, the division region R1 is the determination region HR1, the division region R3 is the determination region HR2, the division region R7 is the determination region HR3, and the division region R9 is the determination region HR4.

Next, in the step S64, the maximum discharge amount Xmax of ink is calculated for each determination region HR1 to HR4. The maximum discharge amount Xmax is a value corresponding to the amount of ink discharged from the print head 141 in a case where it is assumed that so-called solid printing that discharges ink evenly over the entire determination region is performed. At this time, in a case where the areas of all of the determination regions HR1 to HR4 are the same, the four maximum discharge amounts Xmax all have the same value. However, in a case where regions with a wide area and regions with a narrow area are mixed in each of the determination regions HR1 to HR4, the maximum discharge amount Xmax for the determination region with a wide area becomes greater than the maximum discharge amount Xmax for the determination region with a narrow area.

In the step S65, actual ink discharge amount Xr that is the amount of ink discharged to the determination region in actual use is calculated for each determination region HR1 to HR4. For example, when forming an image on the first surface based on the printing data acquired in the step S61, the shape and size of the image formed on the determination region is ascertained for each determination region HR1 to HR4. The amount of ink necessary when forming the image on the determination region is calculated for each determination region HR1 to HR4. The value calculated in this way is the actual ink discharge amount Xr of each determination region HR1 to HR4.

Next, in the step S66, the discharge ratio JR of each determination region HR1 to HR4 is calculated. That is, the quotient (=Xr/Xmax) in which the actual ink discharge amount Xr is divided by the maximum discharge amount Xmax is the discharge ratio JR. In the next step S67, whether determination regions in which the discharge ratio JR is the determination ratio JRTh or more are present in each determination region HR1 to HR4 is determined.

Here, the sheet P more easily curls as more ink is attached to the periphery of the corners PK1 to PK4. Here, it is possible to predict whether there is potential for the sheet P to curl due to printing on the first surface by predicting the attachment amount of ink on the determination regions HR1 to HR4 that are the division regions that include the corners PK1 to PK4. That is, the determination ratio JRTh is the determination value for determining whether there is potential for the sheet P to curl in light of the discharge ratio.

In a case where the discharge ratio JR is less than the determination ratio JRTh in all of the determination regions HR1 to HR4 (steps S67: NO), it is determined that the sheet P is not curled even when printing is performed on the first surface (step S68), and the curl determination process (step S31) in FIG. 7 finishes.

Meanwhile, in a case where the discharge ratio JR is the determination ratio JRTh or more in at least one of the determination regions of each determination region HR1 to HR4 (step S67: YES), it is determined that there is potential for the sheet P to curl due to printing on the first surface (step S69), and the curl determination process (step S31) in FIG. 7 finishes.

Above, according to the printing apparatus 11 of the embodiment, it is possible to further obtain the effects shown below in addition to the same effects as effects (1) and (4) to (6) in the first embodiment.

(7) When performing duplex printing on the sheet P, curling easily occurs in the sheet P when performing printing on the second surface in a situation where ink is attached due to printing on the first surface. Here, in the embodiment, when performing printing on the second surface of the sheet P, it is determined whether the charge eliminating unit 581 is arranged at the charge elimination position or at the retreated position. When it is determined to arrange the charge eliminating unit 581 at the charge elimination position, the charge eliminating unit 581 is made to come in contact with the second surface of the sheet P transported by the transport belt 53, and the electric charge is eliminated from the second surface. In so doing, the electrostatic adsorption force of the sheet P due to the transport belt 53 increases and the sheet P becomes less prone to curling on the transport belt 53. As a result, it is possible for the occurrence of printing defects to be suppressed by the amount that it becomes difficult for a phenomenon in which the sheet P comes in contact with the print head 141 or the like to occur.

(8) In the embodiment, in a case where it is determined that there is potential for the sheet P to curl when printing is performed on the first surface, the charge eliminating unit 581 is arranged at the charge elimination position when performing printing on the second surface. Therefore, because the electric charge is eliminated from the second surface by the charge eliminating unit 581 contacting the second surface during printing on the second surface, it is possible for the electrostatic adsorption force of the sheet P to be increased due to the transport belt 53. As a result, the sheet P does not easily curl on the transport belt 53. Accordingly, it is possible for the occurrence of printing defects to be suppressed by the amount that it becomes difficult for a phenomenon in which the sheet P comes in contact with the print head 141 or the like to occur. On the other hand, in a case where it is determined that the sheet does not curl even when printing is performed on the first surface, the charge eliminating unit 581 is arranged at the retreated position when performing printing on the second surface. Therefore, during printing on the second surface, the charge eliminating unit 581 does not come in contact with the sheet P. Therefore, regardless of form of printing on the first surface, it is possible for deterioration of the charge eliminating unit 581 to be delayed by the amount that the charge eliminating unit 581 becomes less prone to deterioration compared to a case where the charge eliminating unit 581 is constantly arranged at the charge elimination position during printing on the second surface.

(9) As described above, the sheet P more easily curls as the attachment amount of ink on periphery of the corners PK1 to PK4 of the sheet P increases. Here, in the embodiment, the determination regions HR1 to HR4 that include the corners PK1 to PK4 of the sheet P are set, and, when it is possible to determine that the attachment amount of ink to the determination regions HR1 to HR4 is large, it is determined that there is potential for the sheet P to curl due to printing on the first surface. When it is possible to predict that the sheet P does not curl by determining the position of the charge eliminating unit 581 based on the determination results, the charge eliminating unit 581 does not come in contact with the sheet P during printing on the second surface. Accordingly, it is possible for deterioration of the charge eliminating unit 581 to be delayed by the amount that the charge eliminating unit 581 becomes less prone to deterioration compared to a case where the charge eliminating unit 581 is constantly arranged at the charge elimination position during printing on the second surface.

(10) Meanwhile, because ink is not yet attached to the sheet P, when printing on the first surface is different to when printing on the second surface, the potential for curling of the sheet P is low. Here, in the embodiment, the charge eliminating unit 581 is arranged at the retreated position during printing on the first surface and the charge eliminating unit 581 is not brought into contact with the sheet P. In so doing, it is possible for lowering of the elimination efficiency of the electric charge from the sheet P by the charge eliminating unit 581 to be suppressed by the amount that the charge eliminating unit 581 becomes less prone to deterioration compared to a case where the charge eliminating unit 581 is arranged at the charge elimination position during printing on the first surface.

Third Embodiment

Next, a third embodiment in which the printing apparatus 11 is exemplified will be described. In the third embodiment, when printing on the second surface during duplex printing, the feature of causing the pressing force of the charge eliminating unit 581 with respect to the sheet P to change based on the discharge ratio on the first surface is different to the first embodiment. Accordingly, in the following description, the parts different from the first embodiment are mainly described, the same members and configurations as the first embodiment are given the same reference numbers, and overlapping description thereof will not be provided.

In the embodiment, it is possible for the actuator 582 in FIG. 2A to cause the pressing force with which the charge eliminating unit 581 presses on the sheet P transported while electrostatically adsorbed on the transport belt 53 to change. That is, the actuator 582 is configured as the variable pressing force mechanism unit.

In the embodiment, in the step S37 in FIG. 7, when arranging the charge eliminating unit 581 to the charge elimination position, the charge elimination controller 94 in FIG. 5 sets the pressing force of the charge eliminating unit 581 with respect to the sheet P by performing driving control for the actuator 582 based on the discharge ratio JR calculated in the step S66 in FIG. 8.

Specifically, in the step S69 in FIG. 8, the charge elimination controller 94 performs driving control of the actuator 582 so that the pressing force of the charge eliminating unit 581 with respect to the sheet P increases as the discharge ratio JR increases when it is determined that there is potential for the sheet to curl.

The other processing procedure when executing the duplex printing in the embodiment is the same as the processing procedure described using the flowchart in FIGS. 7 and 8 in the second embodiment.

Each embodiment may be modified as outlined below.

- In each embodiment, the support roller 57 may be a roller configured by a material other than a metal material (for example, a synthetic resin), as long as the roller is configured to be driven to rotate by the operation of the transport belt 53.
- In each embodiment, the support roller 57 may not be grounded.
- In each embodiment, as long as it is possible for the sheet P to be electrostatically adsorbed on the transport belt 53 even if the sheet P is not pushed against the transport belt 53 by the support roller 57, the support roller 57 may not be provided.
- In the second embodiment, the setting method of the determination regions HR1 to HR4 may be modified as shown below. That is, the first surface of the sheet P is divided into a plurality and a plurality of division regions is set. A region configured by the end region that is a division region that includes a corner of the sheet P from each of the division regions and a region that adjacent to the end region may be the determination region.

Figure 10:
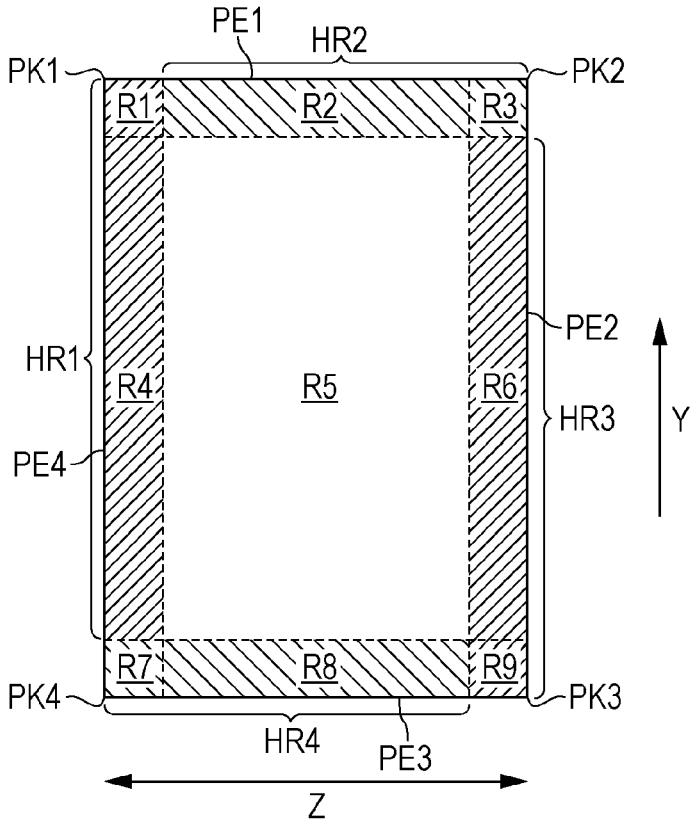
FIG. 10 is a schematic view for illustrating a condition in which a determination region is set on a first surface of the sheet, in a printing apparatus of another embodiment.

FIG. 10 illustrates an example of the setting method of the determination regions. That is, as shown in FIG. 10, a region configured by the division region R1 (end region) that includes the corner PK1 and the division region R4 adjacent to the division region R1 in the transport direction Y of the sheet may be the determination region HR1 and a region configured by the division region R3 (end region) that includes the corner PK2 and the division region R2 adjacent to the division region R3 in the width direction Z of the sheet may be the determination region HR2. Similarly, a region configured by the division region R9 (end region) that includes the corner PK3 and the division region R6 adjacent to the division region R9 in the transport direction Y of the sheet may be the determination region HR3 and a region configured by the division region R7 (end region) that includes the corner PK4 and the division region R8 adjacent to the division region R7 in the width direction Z of the sheet may be the determination region HR4.

The discharge ratio JR is calculated for each determination region HR1 to HR4 set in this way, and in a case where a determination region for which the discharge ratio JR is the determination ratio JRTh or more, it may be determined that there is potential for the sheet P to curl due to printing on the first surface.

- In the second embodiment, the number of division regions formed by dividing the first surface, and as long as the number is two or more, an arbitrary number other than nine may be used.
- Whether the sheet P curls due to printing on the first surface may be determined with a method other than the determination method of curling described in the second embodiment.
- In the second embodiment, in a case of performing duplex printing, the charge eliminating unit 581 may also be arranged as necessary at the charge elimination position during printing on the first surface. For example, during printing on a sheet P with high resistance, the charge eliminating unit 581 may be caused to come in contact with sheet P even during printing on the first surface.

As long as the charge eliminating unit 581 is arranged at the charge elimination position during printing on the first surface, during printing on the second surface, it may be determined that the charge eliminating unit 581 is arranged at the charge elimination position regardless of the determination results of the curl determination process or without performing the curl determination process.

- In the first embodiment, in a case of performing duplex printing on the sheet P, the charge eliminating unit 581 may be arranged at the charge elimination position when performing printing on the second surface regardless of type of sheet P, the installation environment of the printing apparatus 11 or the like.
- In the first embodiment, as long as a configuration is used that determines whether the charge eliminating unit 581 is arranged at the charge elimination position or at the retreated position according to the type of sheet P, position determination of the charge eliminating unit 581 may not be performed based on the temperature TMP and humidity HMD of the installation environment of the printing apparatus 11.
- In the first embodiment, as long as a configuration is used that determines whether the charge eliminating unit 581 is arranged at the charge elimination position or at the retreated position based on the temperature TMP and humidity HMD of the installation environment of the printing apparatus 11, position determination of the charge eliminating unit 581 may not be performed based on the type of sheet P.
- In the first embodiment, as long as it is possible to determine whether the resistance value of the sheet P increased according to the humidity HMD only of the installation environment of the printing apparatus 11, the temperature TMP of the installation environment may not be included in the parameters when performing position determination of the charge eliminating unit 581.

In the first embodiment, when it is possible to determine that the sheet P that is the printing target is a sheet with a high resistance value based on information pertaining to the type of sheet selected by the user, the charge eliminating unit 581 may be arranged at the charge elimination position regardless of the installation environment of the printing apparatus 11.

In the first embodiment, when it is possible to determine that the sheet P that is the printing target is a sheet with a low resistance value based on information pertaining to the type of sheet selected by the user, the charge eliminating unit 581 may be arranged at the retreated position regardless of the installation environment of the printing apparatus 11.

In the first embodiment, even in a case where it is possible to determine that the sheet P that is the printing target is a sheet with a high resistance value based on information pertaining to the type of sheet selected by the user, when it is possible to determine that the resistance value of the sheet P is low based on the installation environment of the printing apparatus 11, the charge eliminating unit 581 may be arranged at the retreated position.

In the first embodiment, even in a case where it is possible to determine that the sheet P that is the printing target is a sheet with a low resistance value based on information pertaining to the type of sheet selected by the user, when it is possible to determine that the resistance value of the sheet P is high based on the installation environment of the printing apparatus 11, the charge eliminating unit 581 may be arranged at the charge elimination position.

In each embodiment, although the charge eliminating unit 581 is displaced in a direction orthogonal to the printing surface Pb of the sheet P, there is no limitation thereto, and the charge eliminating unit 581 may be made to come in contact with printing surface Pb or the charge eliminating unit 581 may be displaced in an arbitrary direction as long as the charge eliminating unit 581 is able to be separated from the sheet P.

The printing unit 14 may be a unit that discharges ink from the print head to the printing surface of the sheet while causing the print head to move in a predetermined scanning direction. The printing unit 14 may be a lateral scanning unit that caused ink to be discharged from the print head 141 to the sheet P while causing the print head 141 to move in the transport direction of the sheet.

In each embodiment, it is possible for the printing apparatus to employ an arbitrary ink as the printing material as long as the ink is able to form an image on the sheet P. That is, the printing material may be granular, teardrop shaped, or the tail may be drawn into a thread shape. For example, the printing material includes fluids such as high or low viscosity fluids, sol, gel water, other inorganic solvents, organic solvents, solutions, liquid resins, and liquid metals (metal melt), as long as the material is in a state where the substance is in a liquid phase. The printing material is not only a fluid as a state of the substance, but also includes materials in which particles of a functional materials formed from a solid substance such as a pigment or metal particle are dissolved, dispersed or mixed in a solvent. Representative examples of the printing material include inks such as those described in each embodiment or liquid crystals. Here, the wording "ink" encompasses general aqueous inks and oil-based inks as well as various liquid compositions such as gel inks and hot melt inks.

The printing medium on which printing is carried out by the printing apparatus may be another medium other than a sheet, as long as it is able to be electrostatically adsorbed on the transport belt 53.

The entire discovery of Japanese Patent Application No.: 2015-035394, filed Feb. 25, 2015 and No.: 2016-004161, filed Jan. 13, 2016 are expressly incorporated by reference herein.

What is claimed is:

1. A printing apparatus, comprising:

a transport belt that transports a printing medium;

a charging unit that supplies an electric charge to the transport belt;

a print head that causes a printing material to be attached to a printing surface of the printing medium that is electrostatically adsorbed on the transport belt, in a case where a surface that comes in contact with the transport belt of both surfaces of the printing medium is a contact surface and a surface on an opposite side to the contact surface is the printing surface;

a charge eliminating unit that is displaceable between a charge elimination position able to come in contact with the printing medium transported by the transport belt and a retreated position unable to come in contact with the printing medium, and that removes the electric charge from the printing surface by coming in contact with the printing surface of the printing medium;

a reversal mechanism that reverses a front and back of the printing medium and guides the printing medium on the transport belt so that a first surface becomes the contact surface and a second surface that is a surface on an opposite side to the first surface becomes the printing surface after printing on the first surface of both surfaces of the printing medium is finished; and a charge elimination control device that controls the position of the charge eliminating unit, wherein the charge elimination control device arranges the charge eliminating unit at the charge elimination position when the printing medium electrostatically adsorbed on and transported by the transport belt is at the position able to come in contact with the charge eliminating unit, and wherein the charge eliminating unit is positioned downstream from the charging unit in a transportation direction of the printing medium, wherein the charge elimination control device:

determines whether the printing medium is curled due to printing on the first surface of the printing medium, and arranges the charge eliminating unit at the charge elimination position when printing on the second surface of the printing medium when it is determined that the printing medium is curled due to printing on the first surface of the printing medium, and arranges the charge eliminating unit at the retreated position when printing on the second surface of the printing medium when it is determined that the printing medium is not curled due to printing on the first surface of the printing medium.

2. The printing apparatus according to claim 1, wherein the charge elimination control device determines whether the charge eliminating unit is made to come in contact with the printing medium transported by the transport belt and controls the position of the charge eliminating unit based on the determination results according to the type of printing medium that is a printing target.

3. The printing apparatus according to claim 1, wherein the charge elimination control device determines whether the charge eliminating unit is made to come in contact with the printing medium transported by the transport belt and controls the position of the charge eliminating unit based on the determination results based on a humidity of an installation environment of the printing apparatus.

4. The printing apparatus according to claim 1, further comprising:

a determination device that determines whether a resistance value of the printing medium that is the printing target increases based on a temperature and the humidity of the installation environment of the printing apparatus, wherein the charge elimination control device arranges the charge eliminating unit at the charge elimination position when it is determined that the resistance value of the printing medium increases by the determination device or arranges the charge eliminating unit at the retreated position when it is determined that the resistance value of the printing medium decreases by the determination device.

5. The printing apparatus according to claim 1, the charge elimination control device arranges the charge eliminating unit at the charge elimination position when carrying out printing on the second surface of the printing medium guided on the transport belt from the reversal mechanism.

6. A printing apparatus, comprising:

a transport belt that transports a printing medium;

a charging unit that supplies an electric charge to the transport belt;

a print head that causes a printing material to be attached to a printing surface of the printing medium that is electrostatically adsorbed on the transport belt, in a case where a surface that comes in contact with the transport belt of both surfaces of the printing medium is a contact surface and a surface on an opposite side to the contact surface is the printing surface;

a charge eliminating unit that is displaceable between a charge elimination position able to come in contact with the printing medium transported by the transport belt and a retreated position unable to come in contact with the printing medium, and that removes the electric charge from the printing surface by coming in contact with the printing surface of the printing medium;

a reversal mechanism that reverses a front and back of the printing medium and guides the printing medium on the transport belt so that a first surface becomes the contact surface and a second surface that is a surface on an opposite side to the first surface becomes the printing surface after printing on the first surface of both surfaces of the printing medium is finished; and a charge elimination control device that controls the position of the charge eliminating unit, wherein the charge elimination control device arranges the charge eliminating unit at the charge elimination position when the printing medium electrostatically adsorbed on and transported by the transport belt is at the position able to come in contact with the charge eliminating unit, and wherein the charge eliminating unit is positioned downstream from the charging unit in a transportation direction of the printing medium, wherein the printing medium includes four lateral edges and includes corners that are connection parts for two of the lateral edges, and in a case where the first surface of the printing medium is divided into a plurality of regions, and a region that includes a corner of the printing medium of each region is the determination region, the charge elimination control device calculates the maximum discharge amount that is the maximum amount of the printing material that is able to be attached to the determination region through discharge of the printing material from the print head to the determination region, calculates the discharge amount that is the amount of printing material discharged from the print head to the determination region based on printing data employed in printing on the first surface of the printing medium, calculates the discharge ratio that is the ratio of the discharge amount to the maximum discharge amount, arranges the charge eliminating unit at the retreated position when printing on the second surface of the printing medium when the discharge ratio in the determination region is less than the determination ratio, and arranges the charge eliminating unit at the charge elimination position when printing on the second surface of the printing medium when the discharge ratio in the determination region is the determination ratio or higher.

7. A printing apparatus, comprising:

a transport belt that transports a printing medium;

a charging unit that supplies an electric charge to the transport belt;

a print head that causes a printing material to be attached to a printing surface of the printing medium that is electrostatically adsorbed on the transport belt, in a case where a surface that comes in contact with the transport belt of both surfaces of the printing medium is a contact surface and a surface on an opposite side to the contact surface is the printing surface;

a charge eliminating unit that is displaceable between a charge elimination position able to come in contact with the printing medium transported by the transport belt and a retreated position unable to come in contact with the printing medium, and that removes the electric charge from the printing surface by coming in contact with the printing surface of the printing medium;

a reversal mechanism that reverses a front and back of the printing medium and guides the printing medium on the transport belt so that a first surface becomes the contact surface and a second surface that is a surface on an opposite side to the first surface becomes the printing surface after printing on the first surface of both surfaces of the printing medium is finished; and a charge elimination control device that controls the position of the charge eliminating unit, wherein the charge elimination control device arranges the charge eliminating unit at the charge elimination position when the printing medium electrostatically adsorbed on and transported by the transport belt is at the position able to come in contact with the charge eliminating unit, and wherein the charge eliminating unit is positioned downstream from the charging unit in a transportation direction of the printing medium, wherein the printing medium includes four lateral edges and includes corners that are connection parts for two of the lateral edges, and in a case where the first surface of the printing medium is divided into a plurality of regions, and a region that is configured by an end region that is a region including a corner of the printing medium and a region that neighbors the end region of each of the regions is the determination region, the charge elimination control device:

calculates the maximum discharge amount that is the maximum amount of the printing material that is able to be attached to the determination region through discharge of the printing material from the print head to the determination region, calculates the discharge amount that is the amount of printing material discharged from the print head to the determination region based on printing data employed in printing on the first surface of the printing medium, calculates the discharge ratio that is the ratio of the discharge amount to the maximum discharge amount, arranges the charge eliminating unit at the retreated position when printing on the second surface of the printing medium when the discharge ratio in the determination region is less than the determination ratio, and arranges the charge eliminating unit at the charge elimination position when printing on the second surface of the printing medium when the discharge ratio in the determination region is the determination ratio or higher.

8. The printing apparatus according to claim 7, wherein a plurality of determination regions including one of the corners is set on the first surface of the printing medium, and the charge elimination control device arranges the charge eliminating unit at the retreated position when printing to the second surface of the printing medium when the discharge ratio in all of the determination regions is less than the determination ratio, and arranges the charge eliminating unit at the charge elimination position when printing on the second surface of the printing medium when the discharge ratio in at least one of the determination regions of each of the determination regions is the determination ratio or higher.

9. The printing apparatus according to claim 8, further comprising:

a variable pressing force mechanism unit that is able to change the pressing force of the charge eliminating unit on the printing medium electrostatically adsorbed on the transport belt with the charge eliminating unit at the charge elimination position, wherein the charge elimination control device causes the pressing force of the charge eliminating unit to change according to the discharge ratio using the variable pressing force mechanism unit.

10. The printing apparatus according to claim 9, wherein the charge elimination control device arranges the charge eliminating unit at the retreated position when carrying out printing on the first surface of the printing medium.

11. The printing apparatus according to claim 10, further comprising:

a support roller which is arranged further upstream in the transport direction than the charge elimination position and that presses the printing medium to the transport belt, wherein the support roller is driven to rotate by an operation of the transport belt.

12. The printing apparatus according to claim 11, wherein the support roller is grounded.

* * * * *